US010946647B2

(12) United States Patent
Sohgawa

(10) Patent No.: US 10,946,647 B2
(45) Date of Patent: Mar. 16, 2021

(54) LIQUID DISCHARGE APPARATUS AND METHOD FOR CONTROLLING LIQUID DISCHARGE

(71) Applicant: Norimasa Sohgawa, Kanagawa (JP)

(72) Inventor: Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/695,786

(22) Filed: Nov. 26, 2019

(65) Prior Publication Data

US 2020/0171819 A1 Jun. 4, 2020

(30) Foreign Application Priority Data

Nov. 30, 2018 (JP) ..... JP2018-226134
Nov. 18, 2019 (JP) ..... JP2019-208225

(51) Int. Cl.
*B41J 2/045* (2006.01)

(52) U.S. Cl.
CPC ..... *B41J 2/04588* (2013.01); *B41J 2/04516* (2013.01); *B41J 2/04541* (2013.01); *B41J 2/04581* (2013.01); *B41J 2/04596* (2013.01)

(58) Field of Classification Search
CPC ..... B41J 2/04516; B41J 2/04596
See application file for complete search history.

(56) References Cited

U.S. PATENT DOCUMENTS 8,414,097 B2 4/2013 Sasaki
8,857,935 B2 10/2014 Endo et al.
9,643,414 B2 5/2017 Sohgawa et al.
2007/0008356 A1* 1/2007 Katoh ..... B41J 2/04596 347/10
2013/0038651 A1* 2/2013 Satou ..... B41J 2/04581 347/9
2019/0283411 A1 9/2019 Sohgawa

FOREIGN PATENT DOCUMENTS

JP 2003-118107 4/2003
JP 2012-081730 4/2012
JP 2014-076561 5/2014
JP 2015-174404 10/2015
JP 2016-055508 4/2016

OTHER PUBLICATIONS

Extended European Search Report for 19211818.0 dated Mar. 27, 2020.

* cited by examiner

*Primary Examiner* — Julian D Huffman
(74) *Attorney, Agent, or Firm* — IPUSA, PLLC

(57) ABSTRACT

A liquid discharge apparatus that includes a liquid discharge head including a nozzle discharging liquid onto a recording medium and a pressure generating unit generating pressure by a change in a drive waveform of the liquid, a drive waveform generating unit generating the drive waveform applied to the pressure generating unit, and a waveform selection unit selectively masking a part of the drive waveform and selecting a pulse of the drive waveform, wherein the drive waveform includes at least one discharge pulse and a micro-drive pulse for causing a change in meniscus so that the liquid is not discharged at a point where the liquid is not discharged on the recording medium, wherein the micro-drive pulse is disposed at a head of a discharge cycle of the drive waveform, and wherein the micro-drive pulse is disposed at an integer multiple of a natural vibration cycle Tc of the liquid chamber.

7 Claims, 17 Drawing Sheets

COMPARATIVE EXAMPLE

LIQUID DISCHARGE APPARATUS AND METHOD FOR CONTROLLING LIQUID DISCHARGE

CROSS-REFERENCE TO RELATED APPLICATIONS

The present application claims priority under 35 U.S.C. § 119 to Japanese Patent Application No. 2018-226134, filed Nov. 30, 2018 and Japanese Patent Application No. 2019-208225 filed Nov. 18, 2019. The contents of which are incorporated herein by reference in their entirety.

BACKGROUND OF THE INVENTION

1. Field of the Invention

The present invention relates to a liquid discharge apparatus and a method for controlling a liquid discharge.

2. Description of the Related Art

In an ink jet recording apparatus for discharging ink droplets to form an image, a technique is known in which a non-discharge pulse is applied to the rear end of a drive waveform to suppress vibration and shorten satellite.

For example, Patent Document 1 discloses a configuration of a drive waveform that performs satellite shortening or vibration damping with an element that changes the electrical potential vertically for the purpose of sharing one non-discharge pulse without providing separate non-discharge pulses for satellite shortening and vibration damping.

However, in Patent Document 1, when only the rear end of the continuous discharge drop is selectively subjected to satellite shortening while the vibration dampening performance in the high frequency driving is improved, it is necessary to detect the rear end portion in the image data and classify the image data of the rear end portion as another area. Therefore, the processing time when the image data is converted into data classified as the discharge drop by the intermediate processing increases, and the capacity of the image data transferred to the printer increases.

Accordingly, in view of the above circumstances, the present invention is to provide a liquid discharge apparatus that can increase satellite shortening effect at the rear end of the discharge droplet without adding any special processing to the image data conversion process.

[Patent Document 1] Japanese Unexamined Patent Publication No. 2015-174404

SUMMARY OF THE INVENTION

In order to solve the above problem, in one aspect of the present invention, a liquid discharge apparatus including a liquid discharge head including a nozzle discharging liquid onto a recording medium, a liquid chamber communicating with the nozzle, and a pressure generating unit generating pressure by a change in a drive waveform of the liquid in the liquid chamber, a drive waveform generating unit generating the drive waveform applied to the pressure generating unit, and a waveform selection unit selectively masking a part of the drive waveform applied to the pressure generating unit and selecting a pulse of the drive waveform applied to the pressure generating unit, wherein the drive waveform includes at least one discharge pulse for discharging the liquid and a micro-drive pulse for causing a change in meniscus so that the liquid is not discharged from the nozzle at a point where the liquid is not discharged on the recording medium, wherein the micro-drive pulse is disposed at a head of a discharge cycle of the drive waveform, and wherein, when electric potential of the micro-drive pulse and electric potential of the discharge pulse change in a same direction, the micro-drive pulse is disposed at an integer multiple of a natural vibration cycle Tc of the liquid chamber with respect to the discharge pulse of a previous discharge cycle during continuous driving.

DESCRIPTION OF THE EMBODIMENTS

Figure 1:
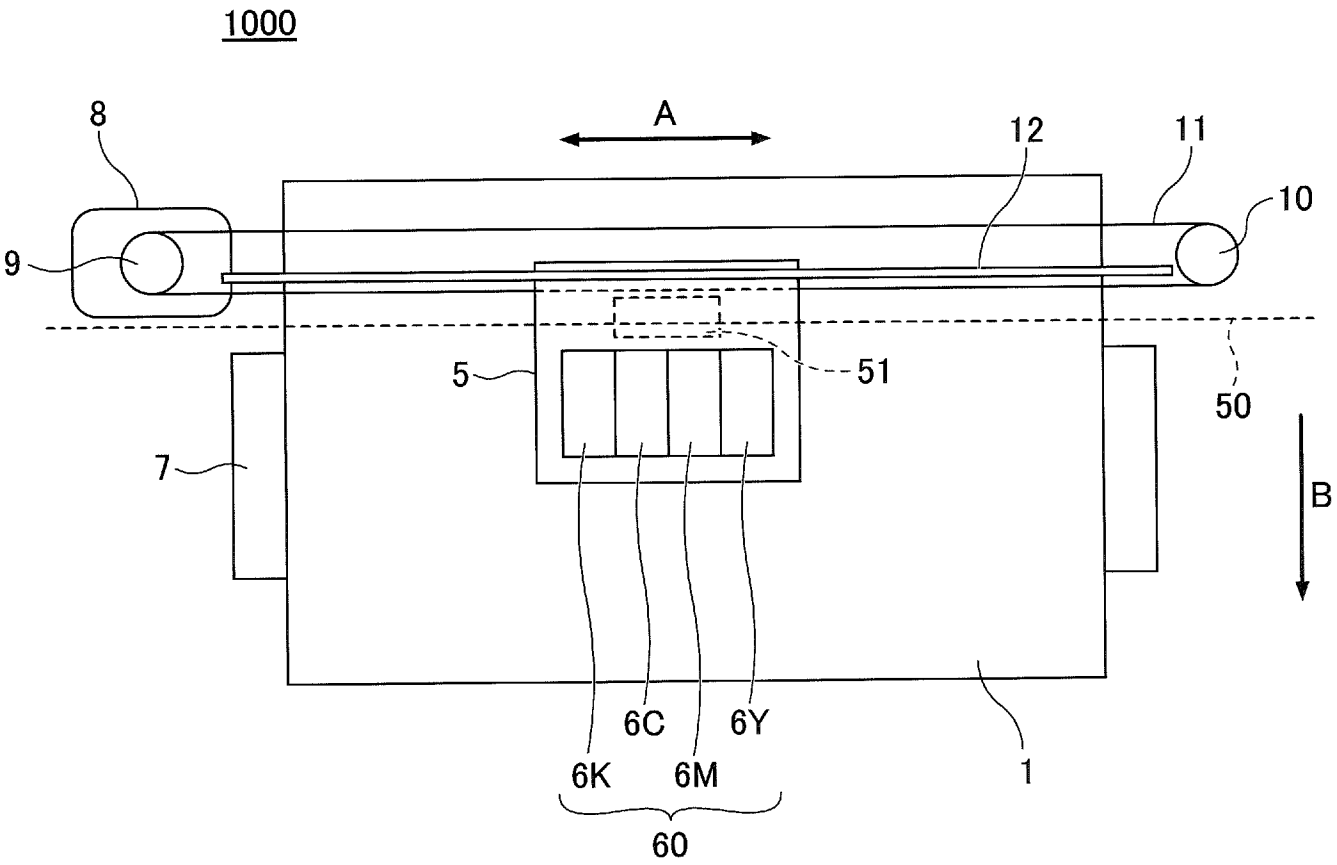
FIG. 1 is a plan view illustrating the periphery of a carriage of a serial-type image forming apparatus according to an embodiment of the present invention.

Hereinafter, an embodiment for carrying out the present invention will be described with reference to the figures. In the following figures, the same components are indicated by the same reference numerals, and overlapping descriptions may be omitted.

<Configuration of Serial-Type Image Forming Apparatus>

First, a configuration of applying the liquid discharge apparatus of the present invention to a serial-type image forming apparatus will be described. FIG. 1 is a plan view illustrating the periphery of a carriage of a serial-type image forming apparatus according to an embodiment of the present invention.

The image forming apparatus 1000 illustrated in FIG. 1 includes a carriage unit 5, a main scan motor 8, a gear 9, a pressing roller 10, a timing belt 11, a guide rod 12, and a platen 7.

The carriage unit 5 includes a plurality of recording heads 6K, 6C, 6M, and 6Y for discharging a liquid such as ink. Specifically, a head group 60 of the plurality of recording heads disposed in the carriage unit 5 is configured by a black head 6K for discharging black (Bk) ink, a magenta head 6M for discharging magenta (M) ink, a cyan head 6C for discharging cyan (C) ink, and a yellow head 6Y for discharging yellow (Y) ink according to the color of the ink. With this configuration, the image forming apparatus 1000 can be applied to the formation of a color image. The recording heads 6K, 6C, 6M, and 6Y constitute the liquid discharge head.

The carriage unit 5 is configured so that the driving force of the main scan motor 8 is transmitted by the gear 9, the pressing roller 10, and the timing belt 11. The carriage unit 5 is mounted so as to slide in the main scanning direction with respect to the guide rod 12. Accordingly, the carriage unit 5 can reciprocate in the main scanning direction illustrated by the arrow A in FIG. 1 by the driving force of the main scan motor 8. The carriage unit 5 functions as a movable body that moves with the recording heads 6K, 6C, 6M, and 6Y.

The platen 7 corresponds to a portion of the conveying means used when conveying the sheet 1 which is an object of arrival in ink droplets discharged from a plurality of recording heads 6K, 6C, 6M, and 6Y.

Here, the sheet 1 is a sheet-like recording medium and is generally paper (plain paper). The sheet 1 according to this embodiment is not limited to paper (plain paper), but also includes a sheet-like material such as coated paper, cardboard, OHP, plastic film, prepreg, copper foil, and the like.

An encoder sensor 51 is provided in the carriage unit 5. The encoder sensor 51 reads a encoder sheet (linear scale) 50 provided along a movement direction (main scanning direction) of the carriage unit 5 and detects a position of the carriage unit 5 during movement.

While the carriage unit 5 reciprocates in the main scanning direction, a plurality of recording heads 6K, 6C, 6M, and 6Y discharge ink droplets of respective colors toward the sheet 1 at a predetermined timing, thereby forming an image on the sheet 1.

The sheet 1 is fed from a paper feed unit to a conveying unit by a paper feed motor. The sheet 1 fed to the transport unit is driven by a transport motor in the transport roller and is conveyed in an arrow B direction (sub-scanning direction) perpendicular to a main scanning direction, and is conveyed to the platen 7, so that image formation starts.

<Configuration of Line-Type Image Forming Apparatus>

Figure 2:
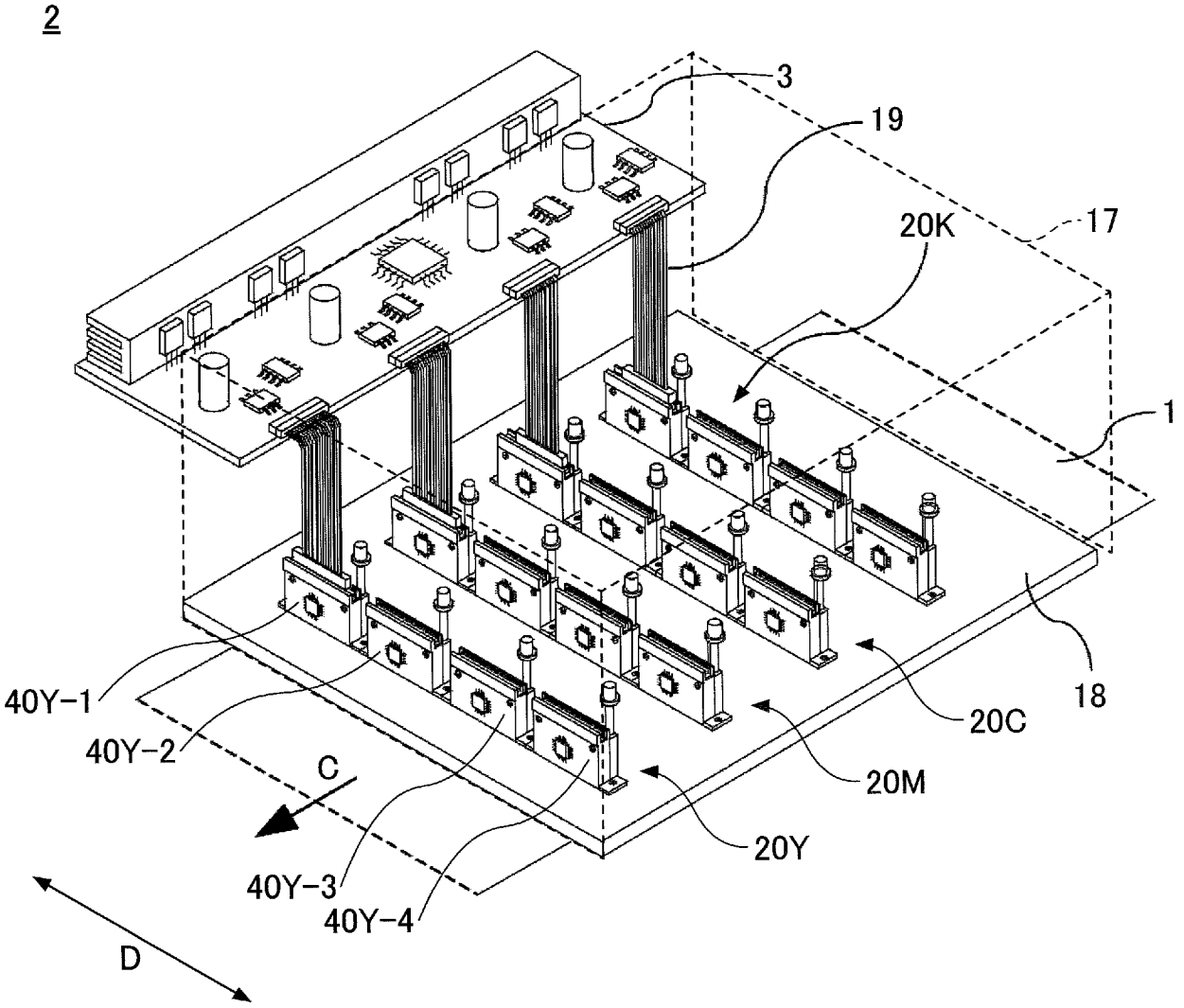
FIG. 2 is an exploded perspective view schematically illustrating a head unit included in an image forming unit of a line-type image forming apparatus according to the embodiment of the invention.

Next, a configuration applying the liquid discharge apparatus of the present invention to a line-type image forming apparatus will be described. FIG. 2 is an exploded schematic perspective view of a head unit included in an image forming unit of a line-type image forming apparatus according to another embodiment of the invention.

The head unit 17 illustrated in FIG. 2 includes four colors of the head module (head array) 20K, 20C, 20M, and 20Y, a drive control board 3, a flat cable 19, and an adjuster plate 18, and the like. The drive control board 3 is illustrated slightly upward for the purpose of illustration.

As illustrated in FIG. 2, the head modules 20K, 20C, 20M, and 20Y are line head types in which a plurality of recording heads 40Y-1 to 40Y-4 are arranged and fixed in a printable manner in the entire area of the paper width (width of the recording medium 1). In FIG. 2, a nozzle array is formed in the D direction indicated by an arrow. Color printing is performed by black, cyan, magenta, and yellow recording heads 40Y-1 to 40Y-4.

The drive control board 3 is a rigid board including a circuit for generating a drive waveform for driving the piezoelectric elements provided by the recording heads 40Y-1 to 40Y-4 and a circuit for generating an image data signal.

The flat cable 19 electrically connects the drive control board 3 to the recording heads 40Y-1 to 40Y-4.

The adjuster plate 18 accurately arranges and fixes the plurality of recording heads 40Y-1 to 40Y-4. The recording heads 40Y-1 to 40Y-4 function as the liquid discharge head.

Each recording head 40Y-1 to 40Y-4 in the head modules 20K, 20C, 20M, and 20Y incorporates piezoelectric elements similar to the serial type recording head 6K. Then, in each recording head 40Y-1 to 40Y-4, the piezoelectric element is driven based on the drive waveform transmitted from the drive control board 3 and the image data signal, and ink (liquid and liquid drops) is discharged to the sheet 1.

The nozzle surfaces of each of the heads 40Y-1 to 40Y-4 are supported on the platen which is the lower surface of the adjuster plate 18 while maintaining a predetermined clearance between the sheet 1 and the predetermined clearance. The sheet 1 is conveyed in the direction of an arrow C.

The recording heads 40Y-1 to 40Y-4 of each of the head modules 20K, 20C, 20M, and 20Y discharge ink droplets according to the conveyance speed of the sheet 1, thereby forming a color image on the sheet 1.

In FIG. 2, the four colors are used as the head, but the color scheme is not limited thereto.

<Bottom Surface of Head Unit>

Figure 3A:
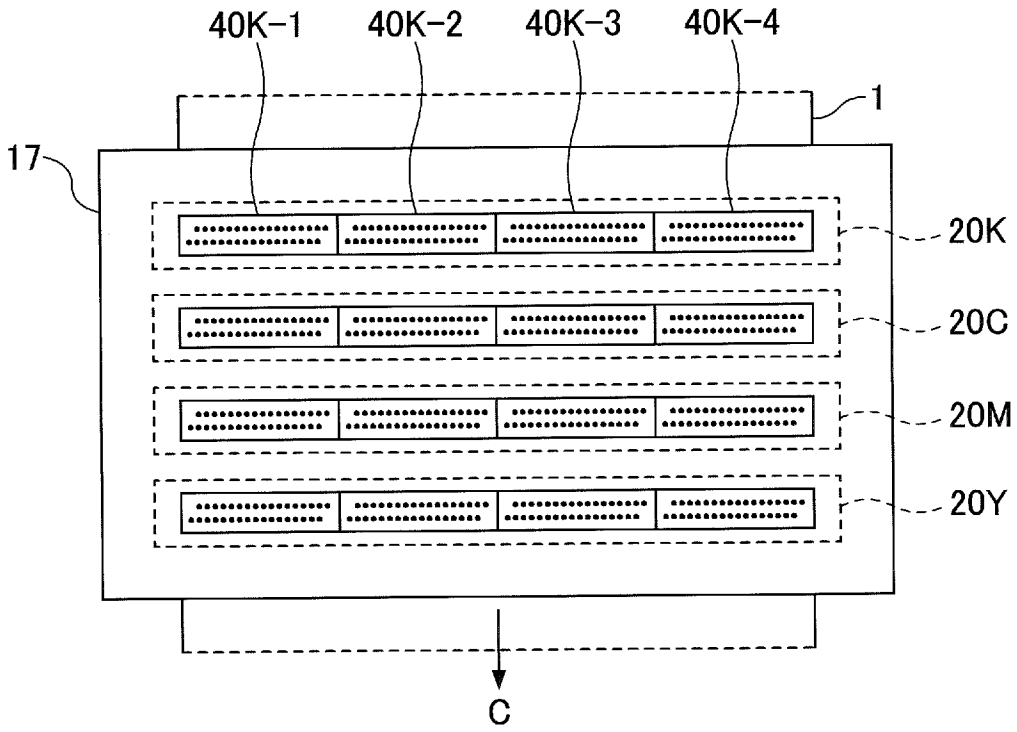
FIGS. 3A and 3B are a bottom view and an enlarged view of the line-type head unit illustrated in FIG. 2, respectively.
Figure 3B:
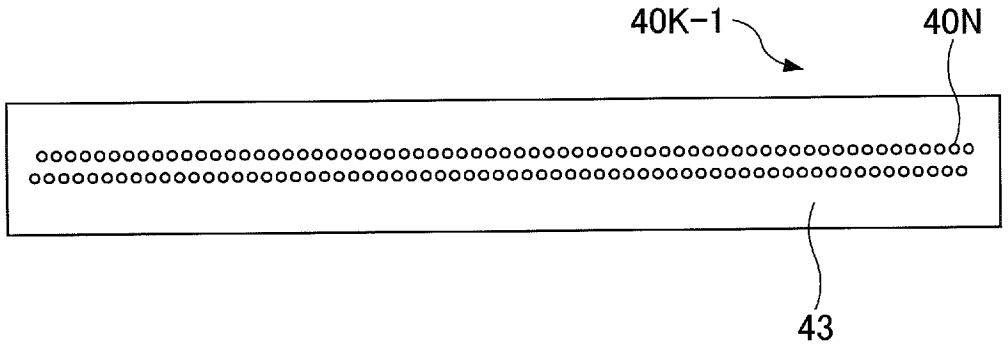

FIGS. 3A and 3B are a bottom view and an enlarged view of the line-type head unit 17 of FIG. 2.

FIG. 3A is a schematic view in which the head unit 17 is arranged in a line head configuration. The head unit 17 illustrated in FIG. 3 is formed of a collection of four head modules 20K, 20C, 20M, and 20Y. The black head module 20K discharges black ink droplets, the cyan head module 20C discharges cyan ink droplets, the magenta head module 20M discharges magenta ink droplets, and the yellow head module 20Y discharges yellow ink droplets.

Each head module 20K, 20C, 20M, and 20Y extends in a direction perpendicular to a transport direction (an arrow direction) of a recording medium S, such as a paper. By arraying the head in this manner, a wide range of printing area width is secured.

FIG. 3B is an enlarged view of the bottom surface of the recording head 40K-1 illustrated in FIG. 3A. A number of print nozzles 40N are staggered in two rows on the nozzle surface (bottom surface) 43 of the recording head 40K. As described above, a large number of print nozzles 40N can be staggered to accommodate high resolution.

In FIG. 3A, an example in which heads are lined up in a linear manner is illustrated. However, a plurality of heads may be lined up in a staggered arrangement. Alternatively, one head may be used to be lined. In addition, the color scheme is not limited to this.

<Head>

Figure 4A:
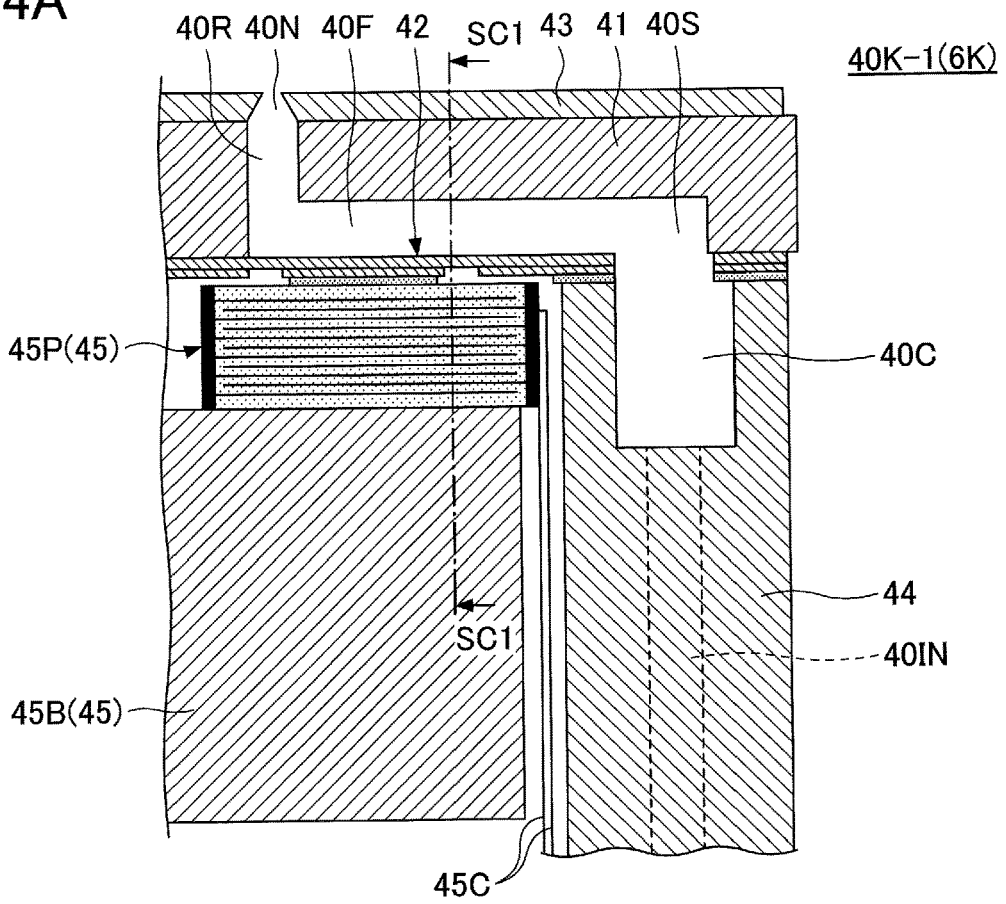
FIGS. 4A and 4B are cross-sectional views in a longitudinal direction and a short direction of the liquid discharge head, respectively.
Figure 4B:
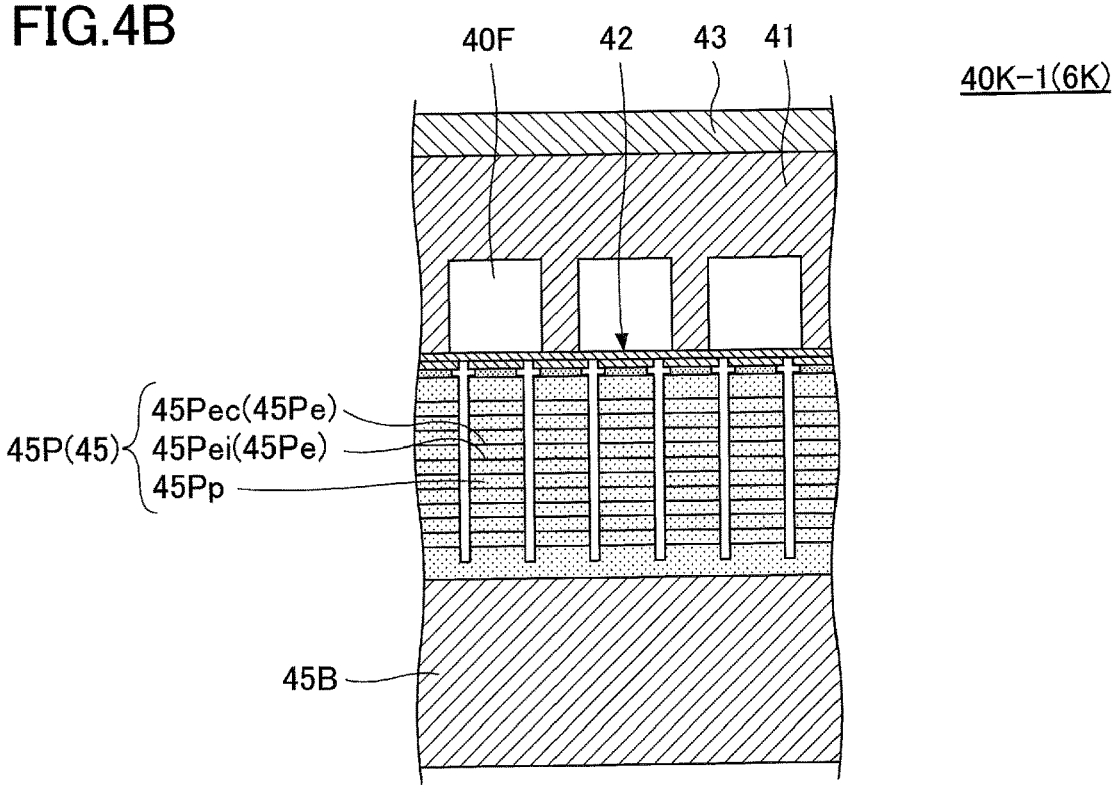

Next, the internal configuration of the recording head (liquid discharge head) will be described with reference to FIGS. 4A and 4B. FIG. 4A is a cross-sectional view of the recording head 40K-1 (6K) in the longitudinal direction of the liquid chamber, and FIG. 4B is a cross-sectional view in the shorter direction of the liquid chamber that is a cross-section of the SC1 of FIG. 4A.

In FIG. 4A, the recording head (40K-1 or the like) of the head unit 17 includes a flow passage plate 41 forming a passage for the discharging ink, a vibration plate 42 bonded to the lower surface (the inside direction of the recording head) of the flow passage plate 41, a nozzle plate 43 bonded to the upper surface (the outside direction of the recording head) of the flow passage plate 41, and a frame member 44 retaining the peripheral portion of the vibration plate 42. The recording head also includes a pressure generating means (actuator means) 45 for deforming the vibration plate 42.

The recording head in accordance with this embodiment forms a nozzle communication passage 40R and a liquid chamber (pressure chamber) 40F, which are flow passages communicating with the print nozzle (discharge port) 40N, by laminating the flow passage plate 41, the vibration plate 42, and the nozzle plate 43. The recording head further laminates the frame member 44 to form an ink inlet 40S for supplying ink to the liquid chamber 40F and a common liquid chamber 40C for supplying ink to the liquid chamber 40F.

According to this embodiment, the frame member 44 is provided with a recess for receiving the pressure generating means, a recess for forming the common liquid chamber 40C, and an ink feed port 40IN for supplying ink from the exterior of the recording head to the common liquid chamber 40C.

In this embodiment, the pressure generating means includes a piezoelectric element 45P which is an electromechanical conversion element, a base board 45B which joins and fixes the piezoelectric elements 45P, and a support portion disposed in a space between adjacent piezoelectric elements 45P. The pressure generating means includes an FPC cable 45C or the like for connecting the piezoelectric element 45P to the driving circuit (the driving IC).

Here, the piezoelectric element uses a laminated type piezoelectric element (PZT) in which the piezoelectric material 45Pp and the inner electrode 45Pie are alternately laminated, as illustrated in FIG. 4B.

The inner electrode 45Pie has a plurality of individual electrodes 45Pei and a plurality of common electrodes 45Pec. The inner electrode 45Pe, in this embodiment, alternately connects the individual electrode 45Pei or the common electrode 45Pec to the end surface of the piezoelectric material 45Pp.

Hereinafter, an operation (pulling-pushing to discharge) in which the recording head discharges ink from the print nozzle 40N will be described in detail.

In the recording head, first, the voltage applied to the piezoelectric element 45P (the pressure generating element) is lowered from a reference potential, and the piezoelectric element 45P is reduced in the direction of its lamination. The recording head deflects and deforms the vibration plate 42 by reducing the piezoelectric element 45P. At this time, the recording head enlarges (expands) the volume of the liquid chamber 40F due to deflection of the vibration plate 42. By this operation, ink flows from the common liquid chamber 40C into the liquid chamber 40F in the recording head.

The recording head then increases the voltage applied to the piezoelectric element 45P to extend the piezoelectric element 45P in the direction of the lamination. The recording head also deforms the vibration plate 42 in the direction of the print nozzle 40N by extending the piezoelectric element 45P. At this time, the recording head reduces (shrinks) the inner capacity (volume) of the liquid chamber 40F due to deformation of the vibration plate 42. This action causes the recording head to apply pressure to the ink in the liquid chamber 40F. The recording head discharges (sprays) ink from the print nozzle (the discharge port) 40N by pressurizing ink.

The recording head then returns the voltage applied to the piezoelectric element 45P to a reference potential and returns the vibration plate 42 to the initial position (restores). At this time, the recording head is depressurized in the liquid chamber 40F due to the expansion of the liquid chamber 40F, and the ink is filled (supplied) from the common liquid chamber 40C to the liquid chamber 40F. Then, after the vibration of the meniscus surface of the print nozzle 40N is attenuated (stabilized), the recording head shifts to an operation for the discharge of the next ink, and the above operation is repeated.

In this manner, the recording head deforms (deflects) the vibration plate 42 using the pressure generating means 45. Accordingly, by changing the capacity (volume) of the liquid chamber 40F, the recording head changes the pressure acting on the ink in the liquid chamber 40F, and as a result, the recording head discharges ink from the print nozzle (discharge port) 40N.

It should be noted that the recording head driving method applicable to the present invention is not limited to the above example (pull-push discharge). For example, the recording head driving method may be pulled or pushed to discharge by controlling a voltage (drive waveform) applied to the piezoelectric element 45P. Further, the pressure generating means 45 may be a thermal type in which ink in the liquid chamber 40F is heated using a heat generating resistor to generate air bubbles, or an electrostatic type in which a vibration plate and an electrode are arranged oppositely on the wall of the liquid chamber 40F and deformed by electrostatic force generated between the vibration plate and the electrode.

As a result of the above, in the head unit 17 of the present embodiment, a black-and-white or a full-color image is formed in the entire image forming region in a conveying operation of the recording medium (sheet 1) using the head modules 20K, 20C, 20M, and 20Y of each color including a plurality of recording heads 40K-1, 40K-2, 40K-3, and 40K-4, respectively. Alternatively, the plurality of recording heads 6K, 6C, 6M, and 6Y are used to form a black-and-white or full-color image throughout the image forming area while the scanning is repeated.

<Explanation of Control>

Figure 5:
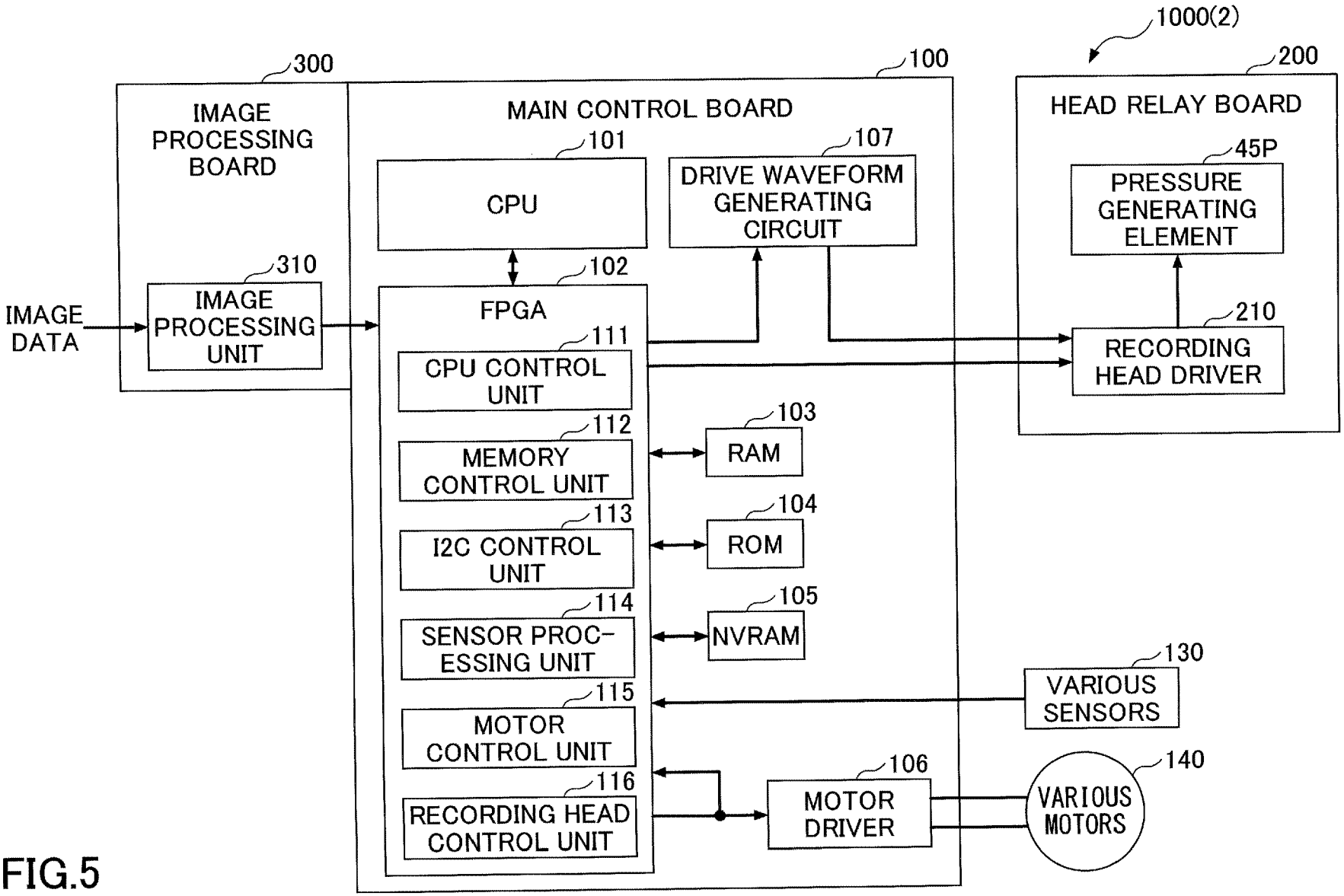
FIG. 5 is a block diagram illustrating an example of a hardware configuration of the image forming apparatus according to the embodiment of the present invention.

FIG. 5 is a block diagram illustrating an example of the hardware configuration of the image forming apparatus 1000 according to the present embodiment. The image forming apparatus 2 includes a main control board 100, a head relay board 200, and an image processing board 300.

The main control board 100 includes a Central Processing Unit (CPU) 101, a Field-Programmable Gate Array (FPGA) 102, a Random Access Memory (RAM) 103, a Read Only Memory (ROM) 104, and a Non-Volatile Random Access Memory (NVRAM) Memory 105, a motor driver 106, a drive waveform generation circuit 107, and the like are implemented.

The CPU 101 is responsible for the entire control of the image forming apparatus 2. For example, the CPU 101 uses the RAM 103 as a work area to execute various control programs stored in the ROM 104 and outputs a control command for controlling various operations in the image forming apparatus 2. At this time, while communicating with the FPGA 102, the CPU 101 cooperates with the FPGA 102 to perform various operation control in the image forming apparatus 2.

The FPGA 102 is provided with a CPU control unit 111, a memory control unit 112, an I2C control unit 113, a sensor processing unit 114, a motor control unit 115, and a recording head control unit 116.

The CPU control unit 111 has a function to communicate with the CPU 101. The memory control unit 112 has a function to access the RAM 103 or the ROM 104. The I2C control unit 113 has a function to communicate with the NVRAM 105.

The sensor processing unit 114 processes the sensor signals of the various sensors 130. The various sensors 130 are a generic term for sensors that detect various conditions in the image forming apparatus 2. In addition to the encoder sensor 51 described above, the various sensors 130 include a paper sensor for detecting the passage of the sheet 1, a temperature and humidity sensor for detecting the ambient temperature and humidity, and a residual amount detecting sensor for detecting the remaining amount of ink in a cartridge (not illustrated). The analog sensor signal output from the temperature/humidity sensor or the like is converted into a digital signal by an AD converter mounted on the main control board 100 or the like and input to the FPGA 102.

The motor control unit 115 controls various motors 140. The various motors 140 are generic names of motors provided by the image forming apparatus 2. The various motors 140 include a main scan motor for operating the carriage unit 5, a sub-scanning motor for conveying the sheet 1 in a sub-scanning direction, a sheet feed motor for feeding the sheet 1, and a maintenance motor for operating a maintenance mechanism 15.

Here, an example of operation control of the main scan motor 8 will be described, and a specific example of control in which the CPU 101 and the motor control unit 115 of the FPGA 102 are coordinated will be described. First, the CPU 101 notifies the motor control unit 115 of a movement speed and a movement distance of the carriage unit 5 along with an instruction to start the operation of the main scan motor 8.

The motor control unit 115 receiving this instruction generates a drive profile based on the movement speed and the movement instruction information notified from the CPU 101, calculates the PWM command value while comparing the value of the encoder supplied from the sensor processing unit 114 (the value obtained by processing the sensor signal of the encoder sensor 51) with the value of the encoder, and outputs the PWM command value to the motor driver 106.

When a predetermined operation is completed, the motor control unit 115 notifies the CPU 101 of the operation completion. Here, an example in which the motor control unit 115 generates a drive profile has been described. However, a configuration in which the CPU 101 generates a drive profile and instructs the motor control unit 115 may be used. The CPU 101 also counts the number of prints and the number of scans of the main scan motor 8.

The recording head control unit 116 passes the head driving data (waveform data), a discharge synchronization signal LINE, and a discharge timing signal CHANGE stored in the ROM 104 to the drive waveform generation circuit 107 to generate a common drive waveform (common drive waveform voltage) Vcom in the drive waveform generation circuit 107.

The common drive waveform Vcom generated by the drive waveform generation circuit 107 (see FIG. 7) is input to the recording head driver 210 described later mounted to the head relay board 200.

First Configuration Example

Figure 6:
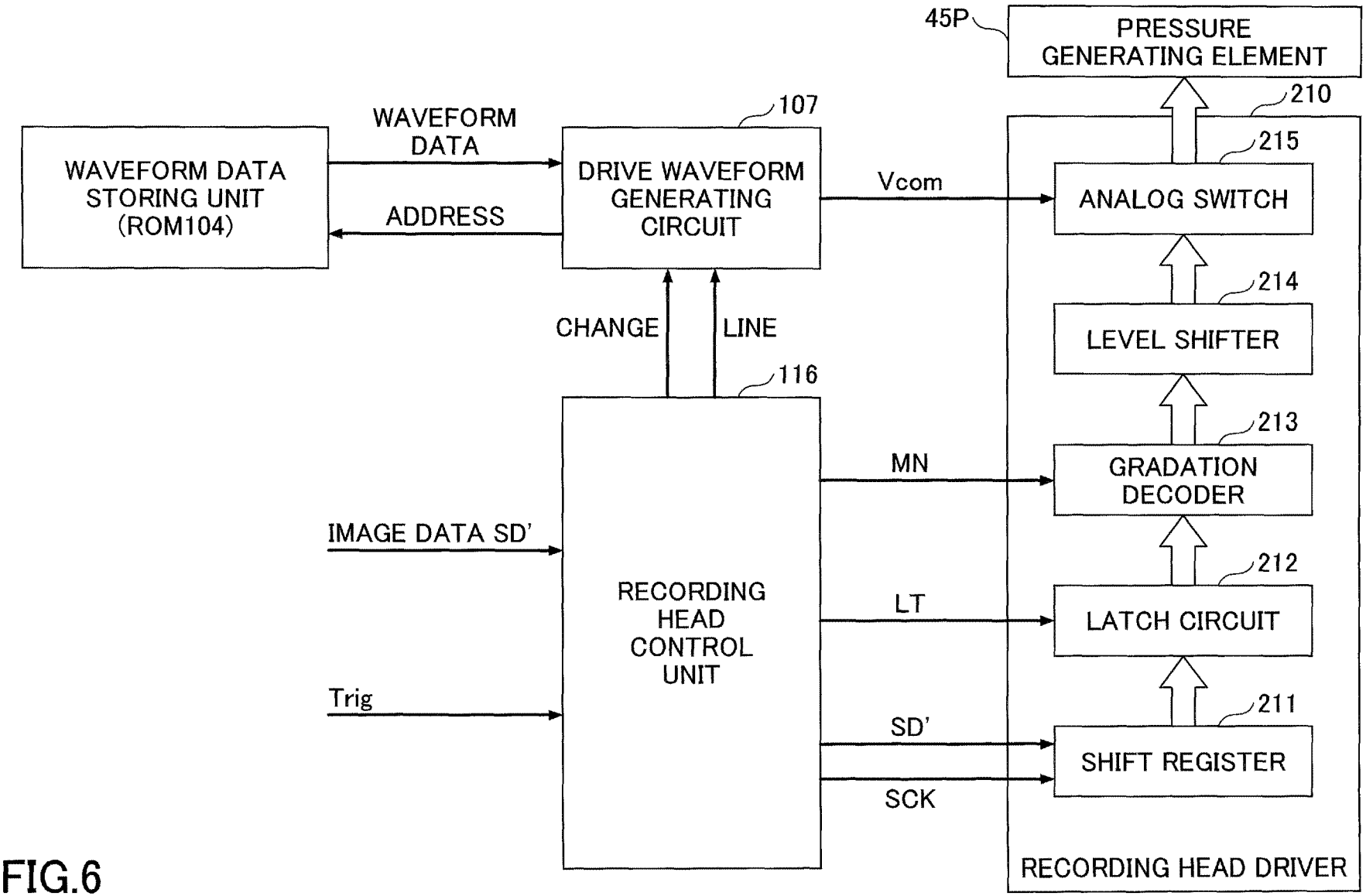
FIG. 6 is a block diagram illustrating a configuration example and a signal around the recording head driver of FIG. 5.
Figure 7:
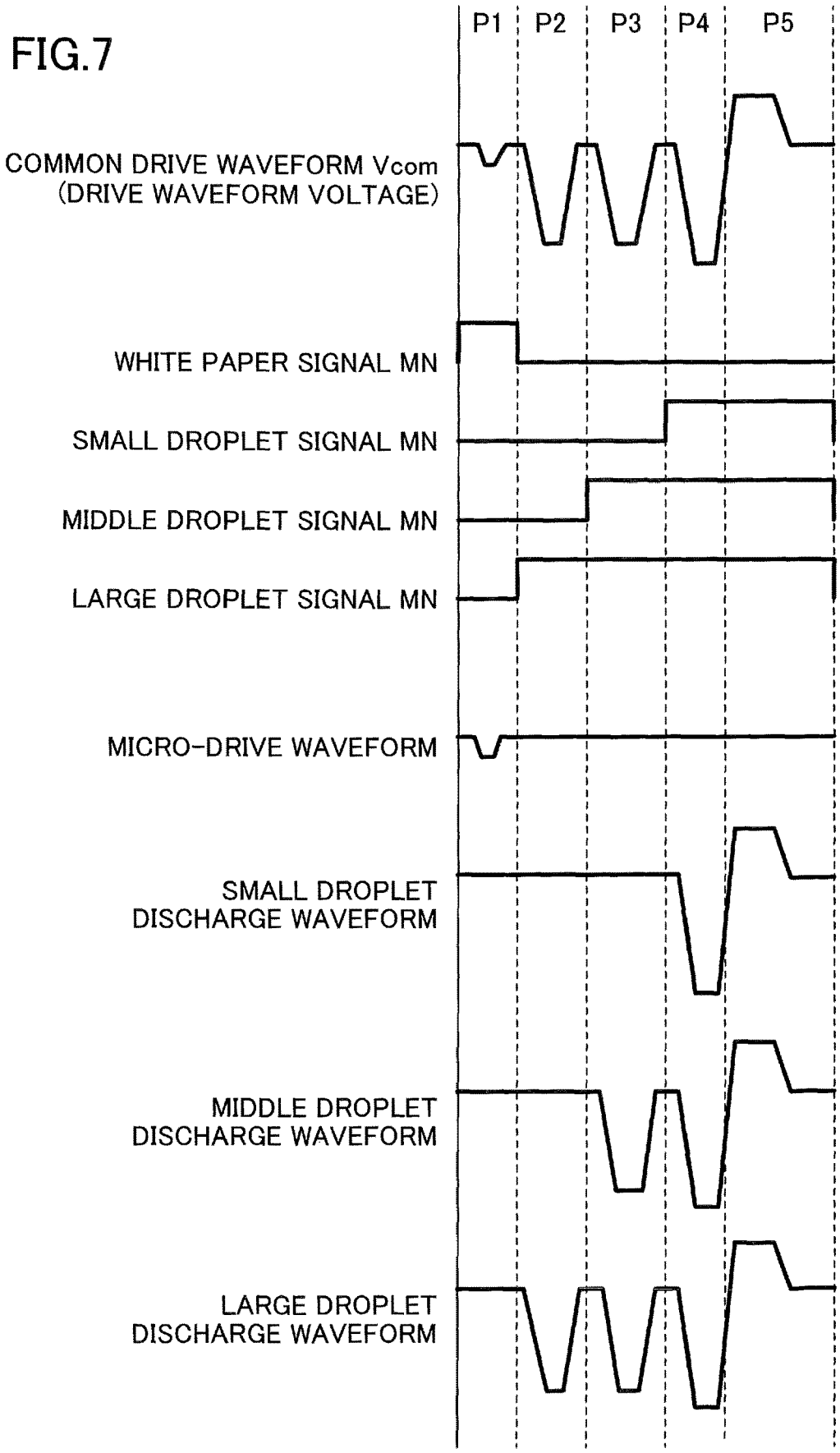
FIG. 7 illustrates an example of a drive waveform according to the embodiment of the present invention.

Next, a selection of waveforms (various pulses) in the common drive waveform of the first configuration example will be described with reference to FIGS. 6 and 7. FIG. 6 is a block diagram illustrating an example of a configuration of a recording head control unit 116, a drive waveform generation circuit 107, and a recording head driver 210. FIG. 7 is a diagram illustrating an example of a drive waveform according to the embodiment of the present invention.

When receiving the trigger signal Trig that triggers the timing of discharge, the recording head control unit 116 outputs the discharge synchronization signal LINE that triggers the generation of the drive waveform to the drive waveform generation circuit 107. The discharge timing signal CHANGE corresponding to a delay amount from the discharge synchronization signal LINE outputs to the drive waveform generation circuit 107.

The drive waveform generation circuit 107, which is a drive waveform generation means, generates the discharge synchronization signal LINE and a common drive waveform Vcom at a timing based on the discharge timing signal CHANGE.

The recording head control unit 116 receives image data SD' after image processing from the image processing unit 310 provided in the image processing board 300 and generates a mask control signal MN for selecting a predetermined waveform (predetermined pulse) of the common drive waveform Vcom according to the size of ink droplets discharged from each nozzle of the recording head 40K-1 based on the image data SD'.

At this time, the generated mask control signal MN selects a micro-drive pulse that causes a movement of the meniscus so that the liquid is not discharged from the nozzle for the nozzle corresponding to the white part (the white part or the non-discharging part) on the recording medium, and the mask process is performed so that other discharging pulses are not selected.

The mask control signal MN is a timing signal synchronized with the discharge timing signal CHANGE. The recording head control unit 116 transmits the image data SD', the synchronization clock signal SCK, the latch signal LT that commands latching of the image data, and the generated mask control signal MN to the recording head driver 210.

In this configuration, the recording head driver 210 functions as a waveform selection unit that selects pulses of the drive waveform applied to the pressure generating element (piezoelectric element, pressure generating means) 45P by selectively masking a portion of the common drive waveform.

The recording head driver 210 includes a shift register 211, a latch circuit 212, a gradation decoder 213, a level shifter 214, and an analog switch 215.

The shift register 211 inputs the image data SD' and the synchronization clock signal SCK transmitted from the recording head control unit 116. The latch circuit 212 latches each resist value of the shift register 211 by a latch signal LT transmitted from the recording head control unit 116.

The gradation decoder 213 decodes the latched value (image data SD') in the latch circuit 212 and the mask control signal MN to output the result. A level shifter 214 converts the logic level voltage signal of the gradation decoder 213 to a level at which analog switch 215 is operable.

An analog switch 215 is a switch that turns on/off the output of the gradation decoder 213 provided via level shifter 214. The analog switch 215 is provided for each pressure generating element (piezoelectric element) 45P associated with the nozzle described above provided by the recording head 40K-1 and is connected to the individual electrodes 83 of the piezoelectric elements 45P corresponding to each nozzle. A common drive waveform Vcom from the drive waveform generation circuit 107 is input to the analog switch 215. As described above, the timing of the mask control signal MN is synchronized with the timing of the common drive waveform Vcom.

Accordingly, the ON/OFF of the analog switch 215 is switched at an appropriate time in accordance with the output of the gradation decoder 213 provided through the level shifter 214, so that a waveform applied to the piezoelectric element 45P corresponding to each nozzle is selected from among the drive waveforms constituting the common drive waveform Vcom. As a result, the size of the ink droplets discharged from the nozzle is controlled.

As illustrated in FIG. 7, among the drive waveforms constituting the common drive waveform Vcom, a waveform (one or more pulses) applied to the piezoelectric element 45P corresponding to each nozzle is selected. As a result, the size of the droplets discharged from the nozzle is controlled, for example, to large droplets, medium droplets, and small droplets.

In the common drive waveform Vcom illustrated in FIG. 7, the drive waveform of the pulse area of P2, P3, and P4 is a discharge pulse for discharging the liquid contributing to the droplet formation. The drive waveform of the pulse area of P5 is the damping waveform and is selected together with the discharge pulse P4. In addition, for the white area where the liquid on the paper P is not discharged, the pulse area of P1 including the micro-drive pulse is selected and the micro-drive pulse is applied to the piezoelectric element (pressure generating element) 45P as the drive waveform. The common drive waveform of FIG. 7 is an example illustrated schematically for the purpose of explaining the selection of waveforms. Specific examples of the potential change direction and pulse spacing of the pulses of the drive waveform used in the control of the present invention will be described in detail with the examples of FIG. 11, FIG. 12, and FIG. 14.

<Applicable Area>

Figure 8A:
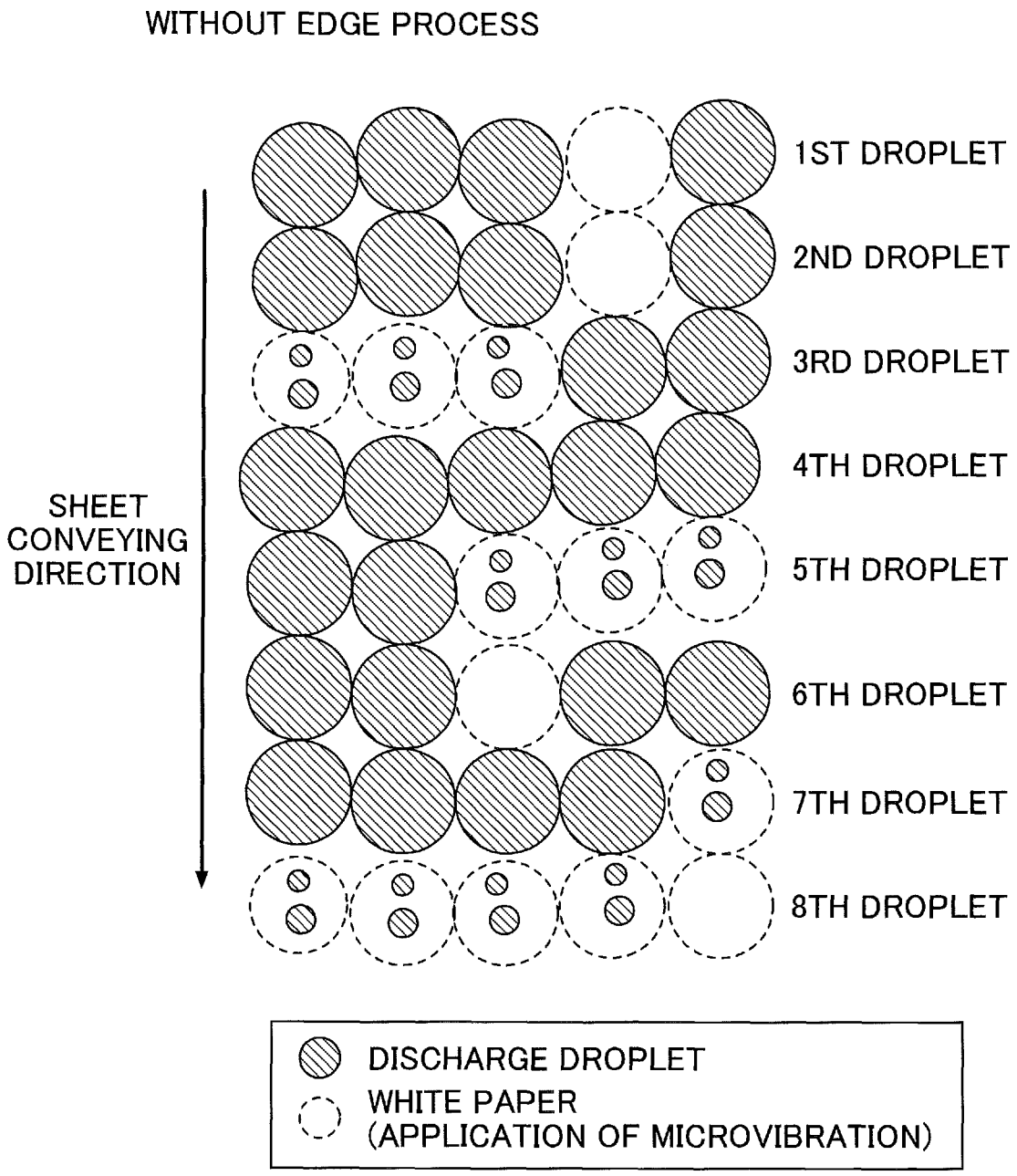
FIGS. 8A and 8B are explanatory views of an effective area for reducing satellite droplets on an image.
Figure 8B:
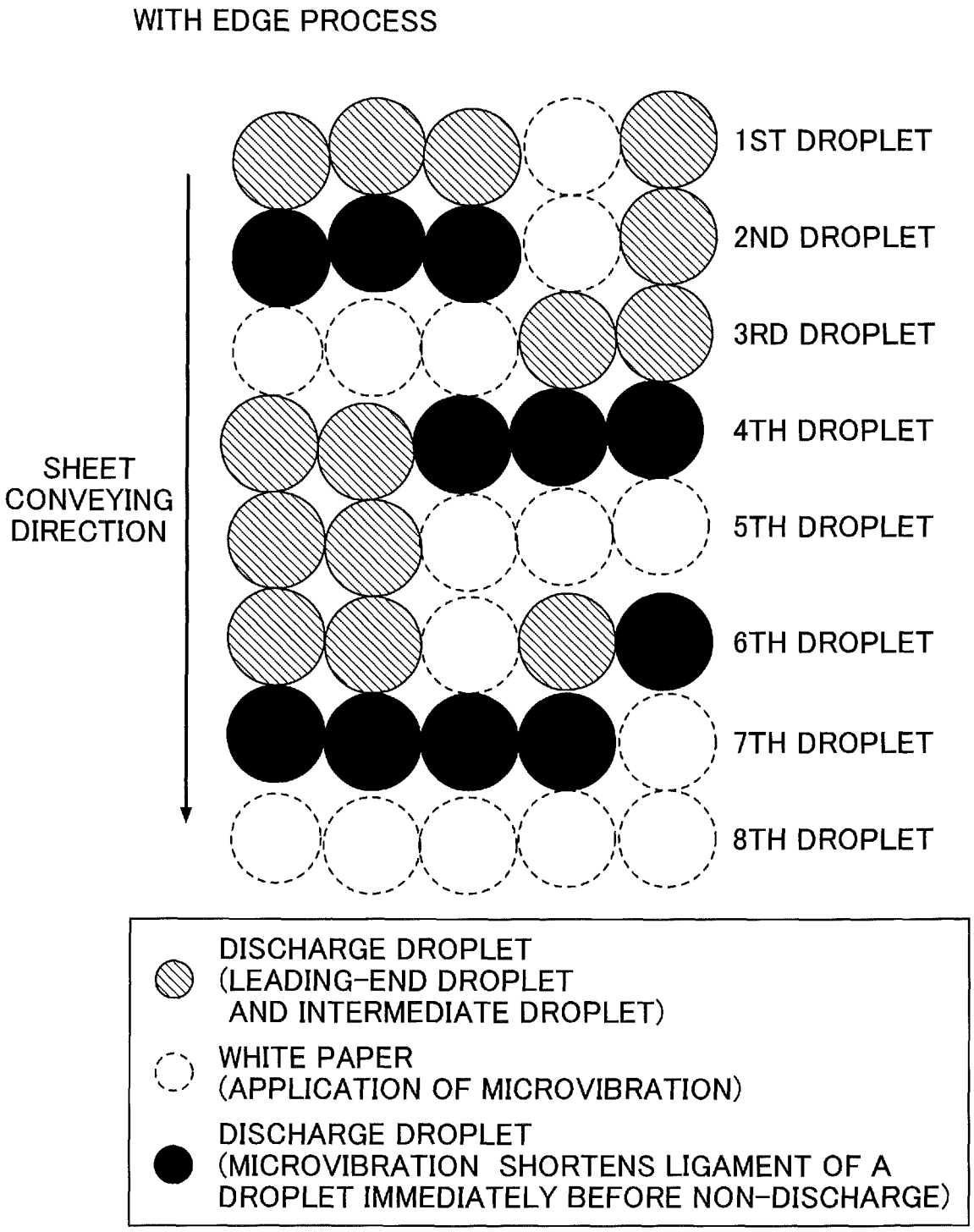

FIGS. 8A and 8B are explanatory diagrams of an effective area for reducing satellite droplets on an image. FIG. 8A illustrates an example in which no processing was performed on a rear edge adjacent to the white area, and FIG. 8B illustrates an example in which the processing was performed in which the micro-drive pulse of the present invention was applied to the white area.

As illustrated in FIG. 8A, when printing in a single-pass format, satellite droplets are prominent in the area where the image switches from print to non-print. A satellite droplet is a dotted small droplet produced by separating from the main droplet of an ink droplet discharged from a nozzle.

Therefore, as illustrated in FIG. 8B, if only the rear edge of the discharged droplet that changes from printing to non-printing, that is, the ink droplet immediately before non-discharge (the droplet immediately before non-discharge) can be reduced, the quality of the printed image can be improved.

In order to prevent drying of the ink in the nozzle, a micro-drive pulse (micro-drive waveform) is applied to the non-discharge nozzle corresponding to the white area during the printing operation.

In the control of the present invention, a micro-drive pulse to prevent ink drying is used to prevent satellite droplets. Therefore, without performing any special processing for the conversion processing of image data, the image data in which a micro-drive pulse is always arranged immediately after the non-discharge immediately preceding droplet can be utilized to provide a satellite shortening effect only on the rear end of the discharge droplet. In addition, the non-discharge immediately before discharge (the discharge droplet rear end) includes the rear end of the continuous discharge droplet that is continuously discharged and a single droplet that is discharged one drop apart as illustrated in the third column of FIGS. 8A and 8B.

Figure 9:
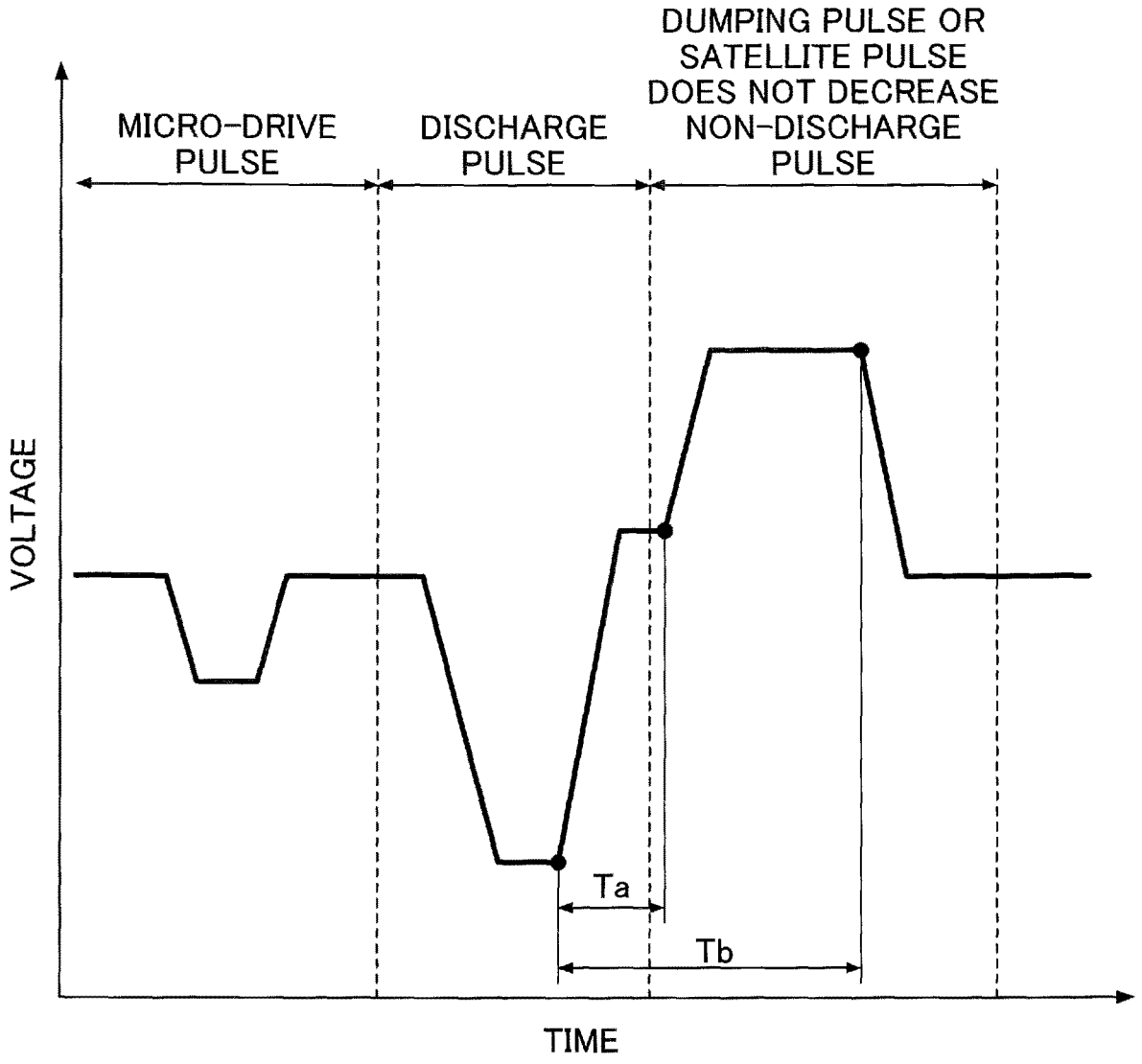
FIG. 9 is an explanatory view of a damping pulse according to a comparative example.

FIG. 9 is an explanatory view of a damping pulse according to a comparative example. As described in FIGS. 6 and 7, it is known that a common drive waveform is switched by a mask process to perform meniscus vibration by a micro-drive pulse in a discharge portion and a white portion (non-discharge portion).

In the comparative example, a damping pulse, which is a non-discharge pulse, is provided immediately after the discharge pulse, and the damping pulse improves discharge stability when the high-frequency drive is performed by increasing the vibration damping performance. At the same time, in order to shorten satellite droplets, vibration is applied to shorten ligament of the non-discharge immediately prior to the discharge pulse, which is the rear end of the discharge droplet.

A ligament is a rod-shaped ink droplet that flies in the air to drag its tail immediately after discharge. Shorter ligaments inhibit satellite droplets.

Further, in the damping pulse, when the meniscus is shortend by making the meniscus vibration due to the discharge droplet anti-resonance, it is effective for improving vibration damping. On the contrary, when the meniscus is increased by making the meniscus vibration due to the discharge droplet resonance, it is effective for satellite shortening (ligament shortening).

The timing (Ta,Tb) of the start-up element and the stop-down element included in the damping pulse and the slope of the previous discharge pulse can be separately aimed at vibration damping and ligament shortening. For example, when aiming at the satellite shortening, it is desirable to place the stop-down timing Tb at an integer multiple of the natural vibration cycle Tc, so that the length of the potential retaining element of the damping pulse is increased.

Here, the natural vibration cycle Tc is the inverse of the natural vibration frequency fc of the liquid chamber 40F (see FIGS. 4A and 4B). The natural vibration cycle is determined uniquely for each nozzle by the nozzle diameter, the pressure chamber volume, and the components of the pressure chamber.

In addition, when aiming to shorten the ligament by adjusting either the timing of starting or any timing of starting the damping pulse, the meniscus vibration caused by discharge is excited, thereby reducing discharge stability.

<Relationship Between the Distance Between the Discharge Pulse and the Non-Discharge Pulse and the Quality of the Drive Waveform>

Figure 10A:
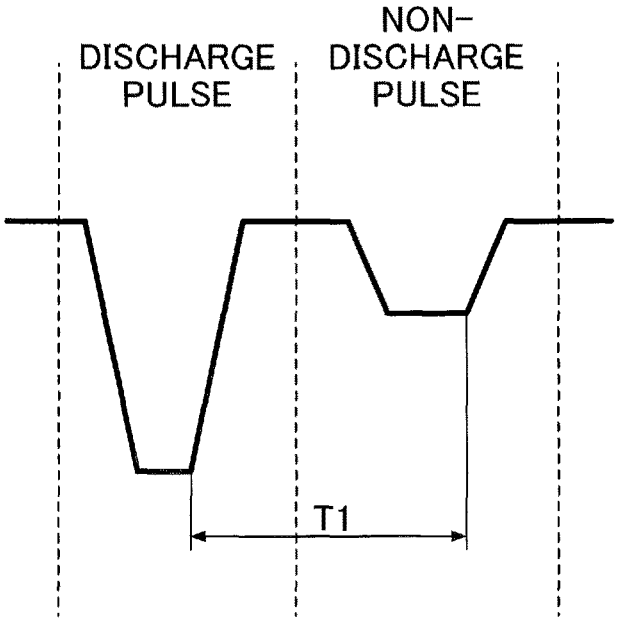
FIGS. 10A and 10B are diagrams illustrating a relationship between the distance of the discharge pulse and the quality of the non-discharge pulse.
Figure 10B:
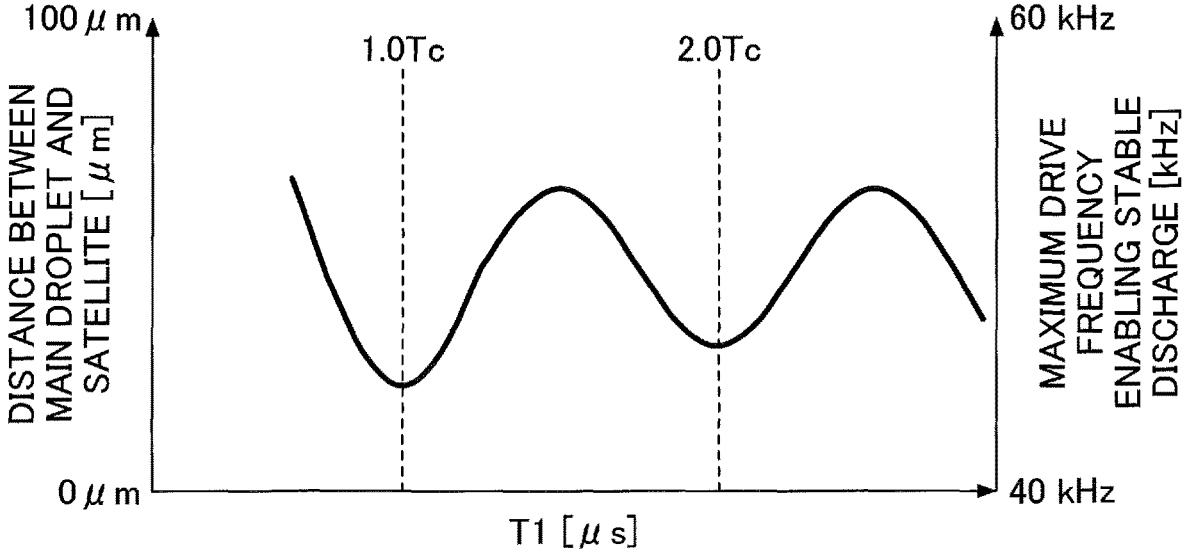

FIGS. 10A and 10B are diagrams illustrating a relationship between the distance between the discharge pulse and the non-discharge pulse and the quality. FIG. 10A is a diagram illustrating the distance between the discharge pulse and the non-discharge pulse, and FIG. 10B is a diagram illustrating the distance between the main droplet and the satellite droplet and the maximum frequency at which stable discharge is possible.

As illustrated in FIG. 10A, when there is a discharge pulse and a non-discharge pulse, when the applied interval T1, which is the distance between the pulses, is changed, the distance between the main droplet of the discharge droplet and the surface of the satellite and the maximum driving frequency that can be stably discharged by the discharge pulse change as illustrated in FIG. 10B. In the present example, a case where the electrical potential of the discharge pulse and the non-discharge pulse change in the same direction will be described.

In FIG. 10B, Tc represents the natural vibration cycle of the liquid chamber, and when the electric potential changes in the same direction, when the application interval T1 is equal to the natural vibration cycle Tc (when T1=1.0 Tc), it resonates and is most effective to accelerate the drop speed. This effect is repeated periodically, and when the spacing T1 between the discharge pulse and the non-discharge pulse approaches an integral multiple of Tc, the droplet speed is accelerated. When the droplet speed is high, the distance between the main droplet and the satellite droplet is close on the recording medium, making it difficult to generate satellite droplets and improving image quality.

On the other hand, the maximum driving frequency that can be stably discharged increases as the non-discharging pulse approaches the Tc (integer+0.5 times), thereby increasing productivity.

Generally, to reduce satellites, productivity is sacrificed, so as to maximize both damping and exciting characteristics with a single non-discharge pulse, a longer period of potential retention is required, and the drive cycle is extended and difficult.

Therefore, in the present invention, the damping pulse, which is a non-discharge pulse immediately after the discharge pulse, increases the discharge stability by making the value close to (integer+0.5) times Tc, and the micro-drive pulse, which is a non-discharge pulse of the next discharge cycle, decreases the satellite by making the value close to an integral multiple of Tc relative to the discharge pulse.

Here, because the micro-drive pulse is not applied during discharge, by applying the micro-drive pulse with the applied interval T1 set to be an integral multiple of Tc immediately after the discharge drop, which switches from discharge to white paper (the white space and the place where liquid is not discharged), the satellite drop suppression effect is activated by vibration only for that period, and only the discharge drop, which switches from discharge to white paper, can be reduced.

This enables both vibration and vibration control without changing the image data, so that only the areas where satellites are conspicuous on the image can be reduced.

In addition, as illustrated in FIG. 10B, because the characteristic of excitation and vibration damping of meniscus is reversed for each ½ cycle of the natural vibration cycle Tc, it is preferable that the micro-drive pulse is disposed with an error within ±¼ Tc from the intended position with respect to the natural vibration cycle Tc of the liquid chamber.

First Embodiment

Figure 11:
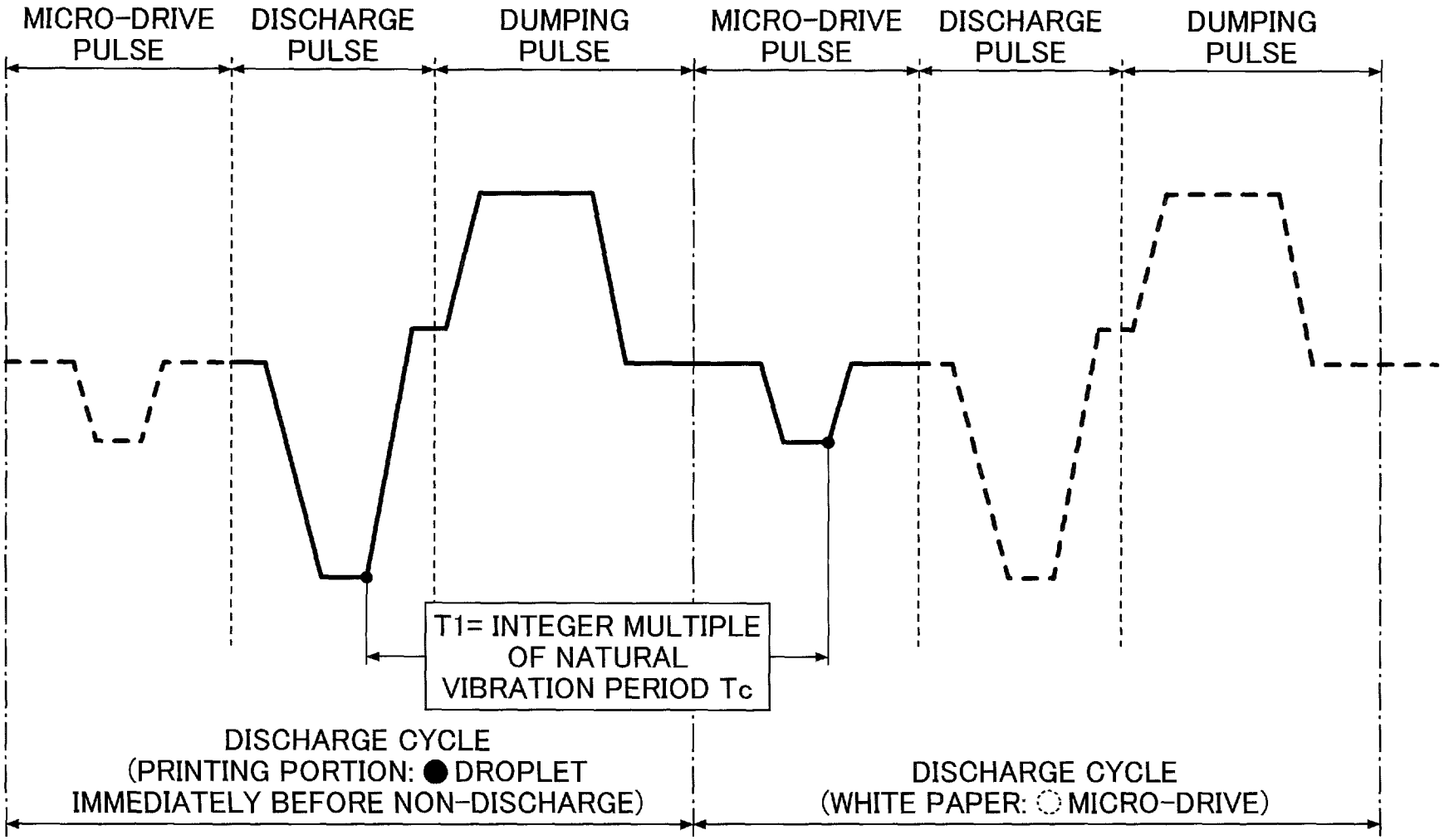
FIG. 11 is a graph illustrating a drive waveform including a micro-drive pulse of satellite drop suppression according to a first embodiment of the present invention.

FIG. 11 is a graph illustrating a drive waveform including a micro-drive pulse of satellite drop suppression according to the first embodiment of the present invention.

In the present embodiment, the control is performed when the electrical potential of the micro-drive pulse and the discharge pulse change in the same direction. In the drive waveform, the micro-drive pulse is disposed at a position where the natural vibration cycle Tc of the liquid chamber is an integral multiple of the discharge pulse of the one discharge cycle immediately before the continuous drive.

Specifically, as illustrated in FIG. 11, the micro-drive pulse and the discharge pulse are convex waveforms (waveform pulling to discharge) having a time series of fall elements having a predetermined gradient, a potential holding element, and rise elements having a predetermined gradient. The micro-drive pulse is arranged so that the time from the start of the rise element of the discharge pulse of the discharge cycle one time ahead to the start of the rise element of the micro-drive pulse is an integral multiple of the natural vibration cycle Tc of the liquid chamber 40F, T1=Tc×N (where N is an integer).

In the present embodiment, in order to shorten satellite in the portion where the white paper (white space) is switched from the printing portion to the non-printing portion, the micro-drive pulse applied in the white paper portion is disposed at the timing where it resonates with the discharge pulse of the printing waveform in the immediately preceding period, thereby shortening the ligament of the non-discharge immediately preceding droplet.

As explained in FIG. 10B, the interval of the micro-drive pulse can be set to be even an integral multiple of Tc. However, because the satellite shortening effect is highest by a factor of 1, and the shortening effect is weakened by a factor of 2 or 3, it is necessary to increase the micro-drive pulse when the pulse is far from the discharge pulse in the previous cycle. However, if the micro-drive is too strong, the meniscus may be agitated and cause a drying failure. Therefore, this control basically places the micro-drive at the head during the discharge cycle of the drive waveform. In this control, the damping pulse disposed at the end of the drive waveform is used only for the purpose of attenuating the meniscus during continuous printing, and the potential retaining element of the damping pulse does not need to be lengthened in order to shorten the ligament. Therefore, the drive waveform length (discharge cycle) can be shortened.

For example, as in the comparative example illustrated in FIG. 9, when it is attempted to suppress vibration with only the damping pulse and shorten the satellite, the pulse length of the damping pulse is required to be 7.5 μs. However, when it is realized by the micro-driving pulse, the pulse length of the damping pulse can be reduced to about 3.3 μs.

In addition, because the micro-drive pulse is provided in advance to agitate the meniscus during a non-discharge cycle in which the blank portion is not printed, and to prevent drying, providing the micro-drive pulse at a predetermined timing does not result in a longer discharge cycle.

As described above, the micro-drive required to prevent drying is used to shorten the ligament of the droplet immediately before non-discharge. In continuous printing, discharge stability is increased by the damping pulse, and satellite is shortened only at the edge of the image. Satellite shortening excites the meniscus, but there is a certain period of time for the meniscus to decay until the next discharge cycle, so it does not affect discharge stability.

Second Embodiment

Figure 12:
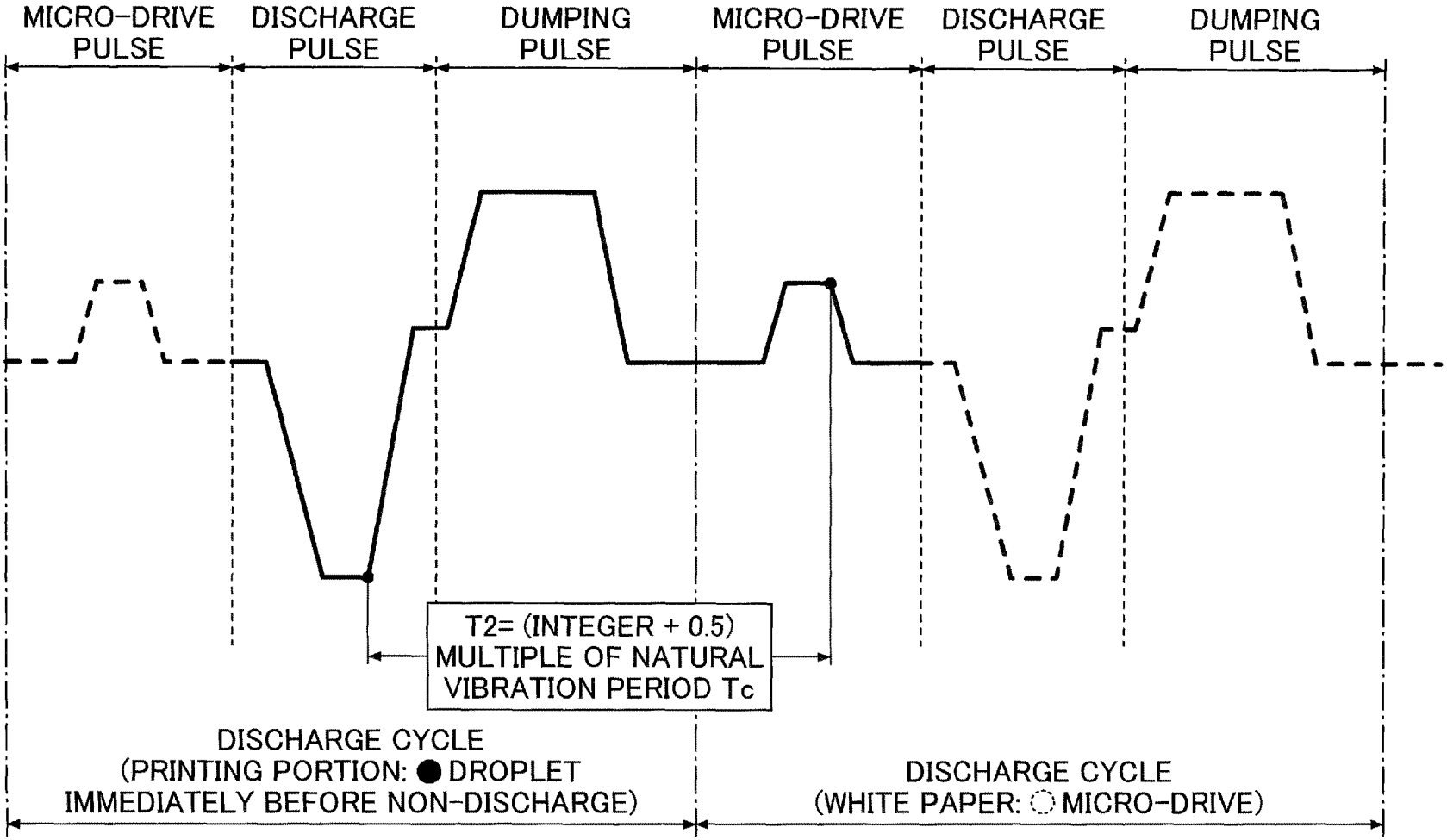
FIG. 12 is a graph illustrating a drive waveform including a micro-drive pulse of satellite drop suppression according to a second embodiment of the present invention.

FIG. 12 is a graph illustrating a drive waveform including a micro-drive pulse of satellite drop suppression according to the second embodiment of the present invention.

In the present embodiment, a control in which the electrical potential of the micro-drive pulse and the discharge pulse change in a different direction is performed. The micro-drive pulse is arranged at a position where "N×Tc+0.5Tc" is obtained when the natural vibration cycle Tc of the liquid chamber is set to an integer N for the discharge pulse of the previous period during continuous driving.

Specifically, as illustrated in FIG. 12, the micro-drive pulse is a convex underneath waveform having a predetermined gradient rise element, a potential holding element, and a fall element having a predetermined gradient fall element in chronological order, and the discharge pulse is a convex wavy having a predetermined gradient fall element, a potential holding element, and a rise element having a predetermined gradient rise element in chronological order.

The micro-drive pulse is arranged so that "T2=N×Tc+0.5Tc" when the natural vibration cycle of the liquid chamber is Tc and integer N, the interval T2 from the start of the rise element of the discharge pulse of the one discharge cycle ahead to the start of the fall element of the micro-drive pulse during continuous drive.

In the present embodiment, the discharge pulse is pulled to discharge, and the micro-drive pulse is pushed to discharge that causes the potential to change in the opposite direction to the discharge. Therefore, the distance between the main droplet of the discharge drop and the satellite on the paper surface in the case of the change in the same direction illustrated in FIG. 10B, and the maximum discharging frequency that can be stably discharged in the discharge pulse vary by 0.5 Tc.

Therefore, by setting the interval between the final discharge pulse and the next micro-drive in the period to be multiplied by (integer+0.5) of the natural vibration cycle Tc, the same effect can be obtained as in the case of an integer multiple of Tc in which the micro-drive according to the first embodiment changes in the same direction as in the pulling to discharge.

In this embodiment, because the application interval T2 of the micro-drive to the discharge pulse of one previous period can be set to "T2=0.5Tc" at the shortest, the drive wavelength can be set to be shorter than that of the first embodiment in which the application interval "T1=1.0Tc" is the shortest.

For this reason, the micro-drive pulse illustrated in the present embodiment has a different direction from the previous discharge pulse in terms of the change in potential, and control using the micro-drive pulse that changes the direction of pushing to discharge is effective when it is desired to shorten the drive waveform length.

Incidentally, when the above control of the first embodiment and the second embodiment is applied to the common drive waveform of FIG. 7, in FIG. 7, the last discharge pulse P4 including the damping pulse P5 is included in all droplets, medium droplets, and large droplets. Therefore, it is possible to suppress the satellite droplets by increasing the ligament shortening effect while stabilizing the discharge by vibration control regardless of the rear end of the continuous discharge droplet or the single droplet of any size.

<Multiple Discharge Cycles>

Figure 13A:
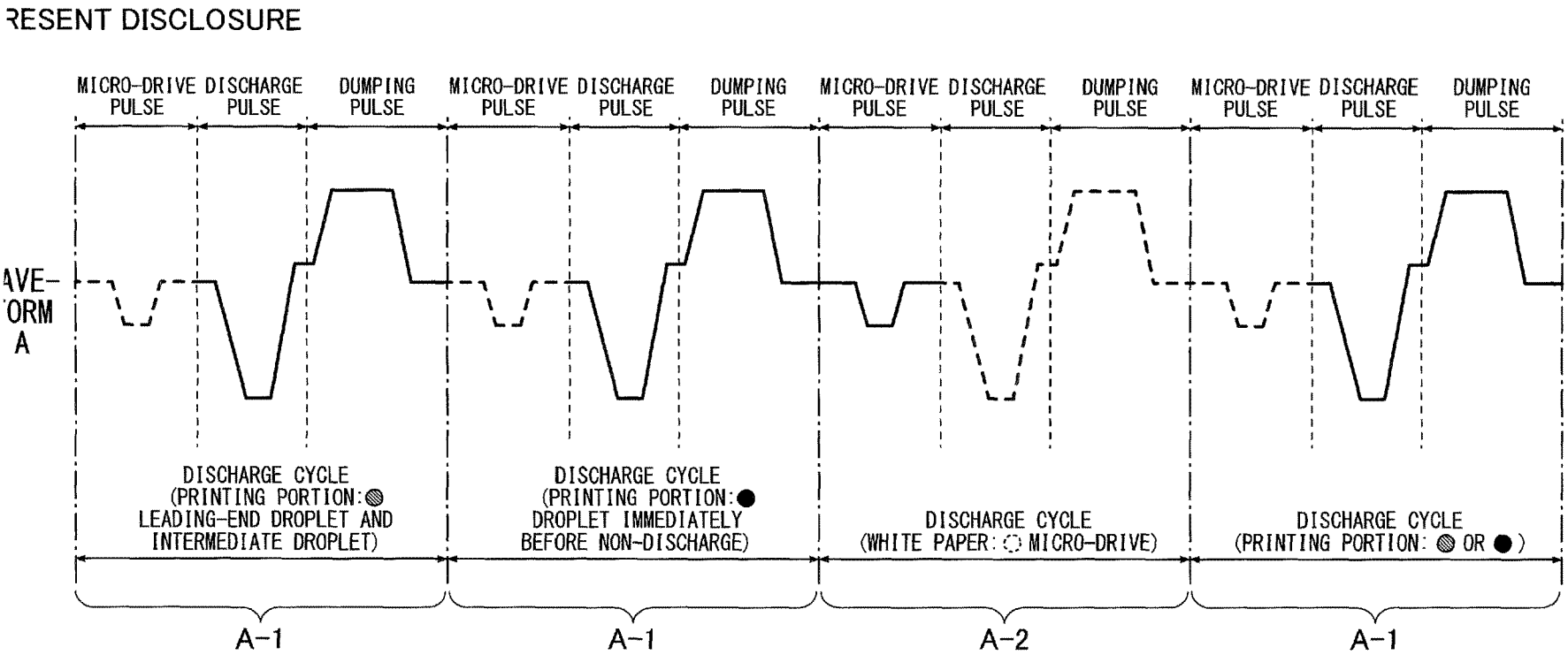
FIGS. 13A and 13B are graphs illustrating a plurality of discharge cycles of a drive waveform including a micro-drive pulse of satellite droplet suppression according to the present invention, and a plurality of discharge cycles of a drive waveform including a micro-drive pulse of satellite droplet suppression according to a comparative example.
Figure 13B:
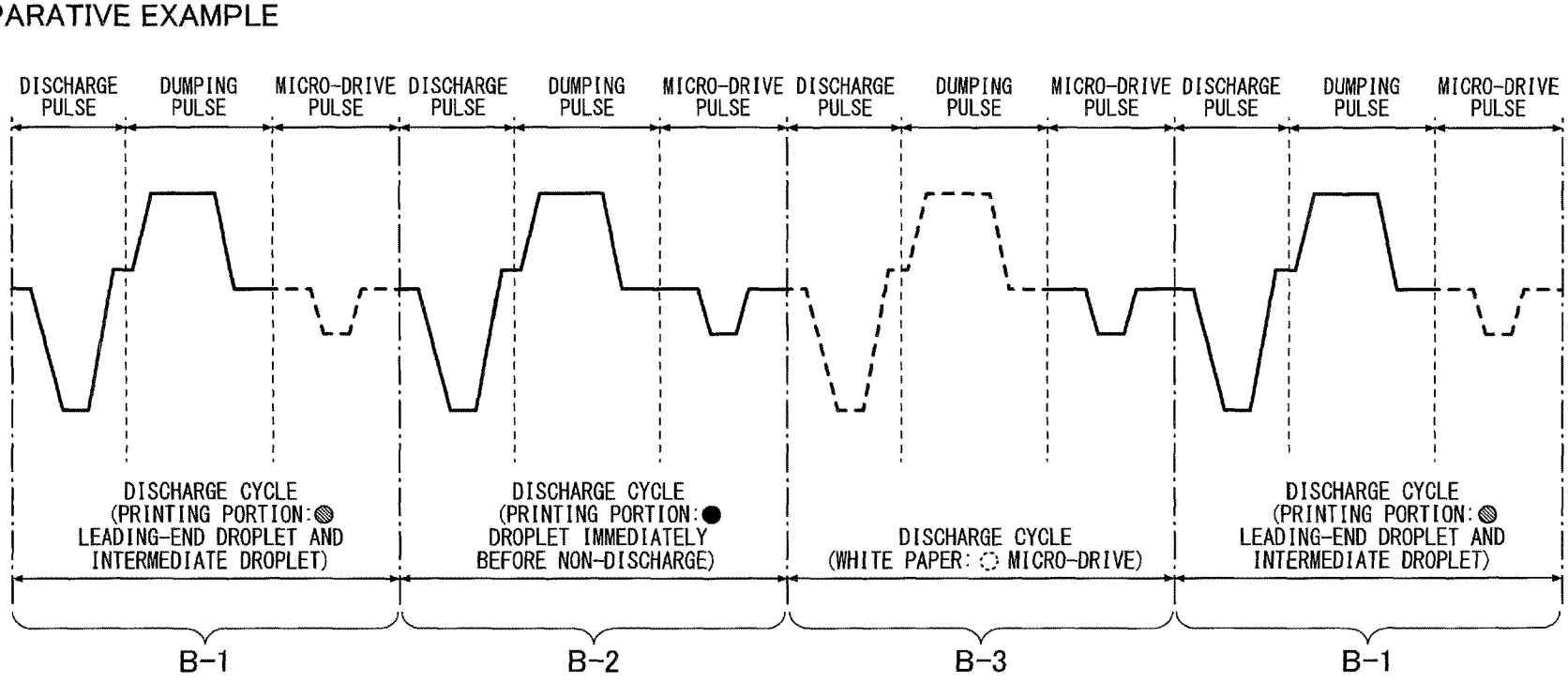

FIGS. 13A and 13B are graphs illustrating a plurality of discharge cycles of a drive waveform including a micro-drive pulse of satellite droplet suppression according to the present invention, and a plurality of discharge cycles of a drive waveform including a micro-drive pulse of satellite droplet suppression according to the comparative example.

FIG. 13A illustrates the waveform of the present invention, and FIG. 13B illustrates the waveform of the comparative example.

The A waveform illustrated in FIG. 13A is an example of the drive waveform of the present invention in which the micro-driving pulse is placed at the top. In the printing unit of the drive waveform of the present invention, the waveform of the droplet immediately before non-discharge and the waveform of the leading-end droplet or the intermediate droplet of the continuous discharge portion are the same.

On the other hand, even when the micro-drive pulse is last placed as in the B waveform in the comparative example, the satellite droplet characteristics and the drying prevention effect can be obtained by setting the timing as described above.

However, when generating the raster data for each drive period separated by a thick dotted line, the B waveform needs to determine whether or not it is immediately before the blank sheet portion, and the waveform of the droplet immediately before non-discharge is different from the waveform of the front end droplet or the intermediate droplet of the continuous discharge portion. Therefore, the A waveform may be binary data corresponding to two waveforms (A-1, A-2), while the B waveform requires processing to identify the three waveforms (B-1, B-2, and B-3) and the blank paper portion. Therefore, it takes a long time to generate raster data at the time of printing and the capacity of the data to be transferred is increased.

In an area in which the discharge cycle of the B waveform is switched from the B-3 waveform to the B-1 waveform, the discharge pulse of the B-1 waveform is arranged immediately after the micro-drive of the B-3 waveform. That is, the micro-drive of the previous cycle is arranged immediately before the next discharge pulse. Therefore, the meniscus vibration caused by the micro-drive pulse of the B-3 waveform, which is the previous period, remains, and there is a possibility that the discharge failure may occur when the motor is driven by the discharge pulse of the B-1 waveform, which is the next period.

On the other hand, when the A waveform is switched from the A-2 waveform to the A-1 waveform, there is a non-driven region represented by the dotted line of the A-2 waveform, so that the meniscus vibration caused by the micro-drive is sufficiently attenuated, and the discharge pulse of the A-1 waveform immediately after the A-2 waveform is not affected by the meniscus vibration caused by the micro-drive pulse.

Thus, the present invention eliminates the need for detecting the digital portion of the image to be printed based on the digital data of the rear end of the image or for replacing the detected portion with data different from that of other areas when applying a non-discharge pulse having the effect of satellite shortening in order to discharge a continuous rear end of the discharge drop or a single drop, which requires satellite shortening.

That is, in the control of the present invention, the waveform is configured such that the rear end of the continuous discharge droplet or the droplet discharged independently functions as a satellite shortening pulse by utilizing the arrangement of the image data, so that it is not necessary to use the extra image data conversion process to increase the quality of a line drawing end.

Because the micro-drive pulse is selected to be applied in a white area (a white paper portion) on the image data, the micro-drive pulse is always arranged immediately after the rear end of the continuous discharge droplet or the applied waveform that causes the single-droplet to be discharged. On the other hand, during the formation of an image by continuous discharge droplets, satellite droplets generated by tip droplets or intermediate droplets in continuous discharge overlap subsequent discharge droplets on paper and do not cause image defects.

As described above, the image data in which the micro-drive pulse is always arranged immediately after the continuous discharge drop is discharged is utilized, and no special processing is performed for the image data conversion process. Therefore, the satellite shortening effect can be improved only when the non-discharge immediately before the discharge is terminated by the micro-drive pulse without increasing the capacity of the image data.

Third Embodiment

Figure 14:
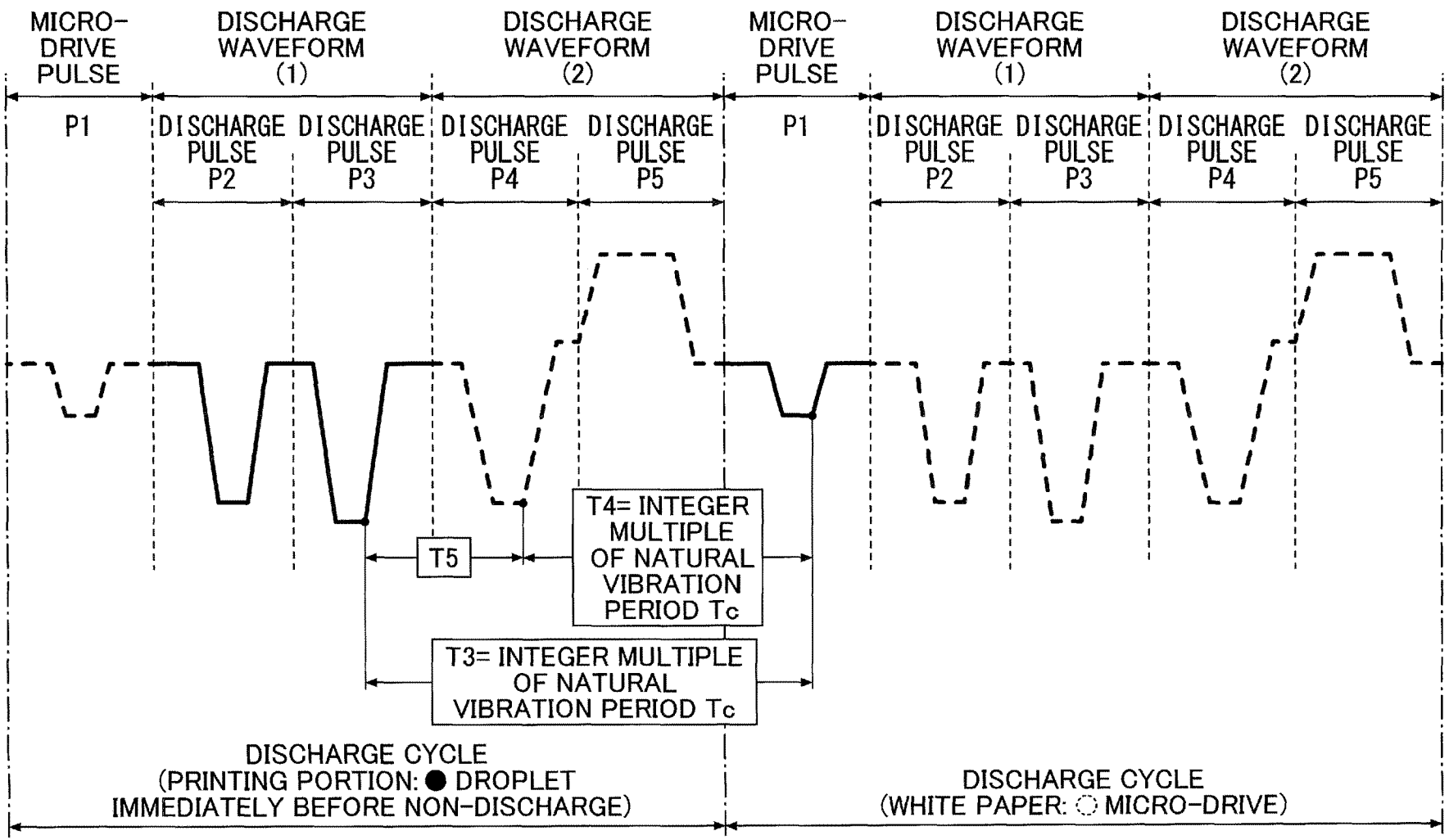
FIG. 14 is a graph illustrating a drive waveform including a micro-drive pulse of satellite drop suppression according to a third embodiment of the present invention.

FIG. 14 is a graph illustrating a drive waveform including a micro-drive pulse of satellite drop suppression according to a third embodiment of the present invention.

In the common drive waveform of FIG. 7 above, all sizes of droplets are selected to include a damping waveform, and the pulse termination of the discharge pulse of all droplet sizes (large, medium, and small) is equal. Therefore, regardless of the drop size, the micro-drive pulse can be applied at the timing where the target position is (T1=Tc×N) with respect to the natural vibration cycle Tc of the liquid chamber.

However, for example, a droplet or a middle droplet has less vibration of the meniscus at discharge and less residual vibration, so that even without the damping pulse, there is less influence on subsequent droplets. Therefore, in a waveform in which a mask is masked from among the common drive waveforms and a mask is selected for each drop size, the waveform for droplets or droplets may include no damping pulse. An example thereof will be described in the present embodiment.

In the present invention, when the drive waveform includes a plurality of pulses and the discharge waveform (1) and the discharge waveform (2) can be switched in accordance with the image data, the discharge pulse P3 at the end of the discharge waveform (1) of the previous period and the interval between the application of the micro-drive pulse P1 at the next discharge cycle T3 are made to be an integral multiple of the natural vibration cycle Tc, so that the discharge waveform (1) is applied to shorten the satellite of the droplets immediately before discharge.

For example, the discharge waveform (1) corresponds to a drop, such as a droplet or a medium droplet, in which the residual vibration is sufficiently low even without being combined with the damping pulse.

Even in the present embodiment, it is not necessary to place a non-discharge pulse with only satellite shortening in the drive waveform, so that productivity can be increased with a short wavelength.

In addition, when it is necessary to suppress residual vibration such as large droplets, selecting a non-discharge pulse (damping pulse P5) that improves the vibration damping performance also eliminates the need to sacrifice the vibration damping performance in order to obtain the satellite shortening effect, thereby improving the discharge stability.

In addition, the discharge pulse P4 included in the discharge waveform (2) and the interval T4 between the application of the micro-drive pulse P1 of the next discharge cycle are set to be an integral multiple of the natural vibration cycle Tc, so that the satellite of the non-discharge immediately preceding drops discharged can be shortend by applying the discharge waveform 2.

Therefore, by making both the application interval T3 and T4 an integer multiple of the natural vibration cycle Tc, the satellite shortening effect can be realized in both the discharge waveform (1) and the discharge waveform (2).

As described above, in order to realize the satellite shortening effect of both the discharge pulse (1) and the discharge pulse (2), the interval T5 between one pulse (discharge pulse P3) termination and another pulse (discharge pulse P4) termination in a plurality of discharge pulses in the drive waveform is set to be an integral multiple of the natural vibration cycle Tc of the liquid chamber. It is preferable that the interval T5 at this time is arranged with an error within ±¼ Tc from the intended position.

Alternatively, in large droplets, the applied drive waveform is large or long, so that residual vibrations of the meniscus are likely to be generated, and satellite droplets tend to be less likely to be generated. Therefore, in the drive waveform, it is possible that control is not aimed at the satellite shortening effect (ligament shortening effect) immediately after the large droplet.

For example, when discharging large droplets, when both the discharge waveform (1) and the discharge waveform (2) are used and no satellite shortening effect is required, the interval T5 between the end of the discharge pulse P3 included in the discharge waveform (1) and the end of the discharge pulse P4 included in the discharge waveform (2) is shifted to an integer multiple of the natural vibration cycle Tc of the liquid chamber, and the application interval T4 of the micro-discharge pulse P1 of the next discharge cycle of the discharge pulse P4 is shifted from an integer multiple of the natural vibration cycle Tc (T4≤Tc×N) so that only the discharge waveform (1) can be controlled to shorten the satellite.

Example of Second Configuration

Figure 15:
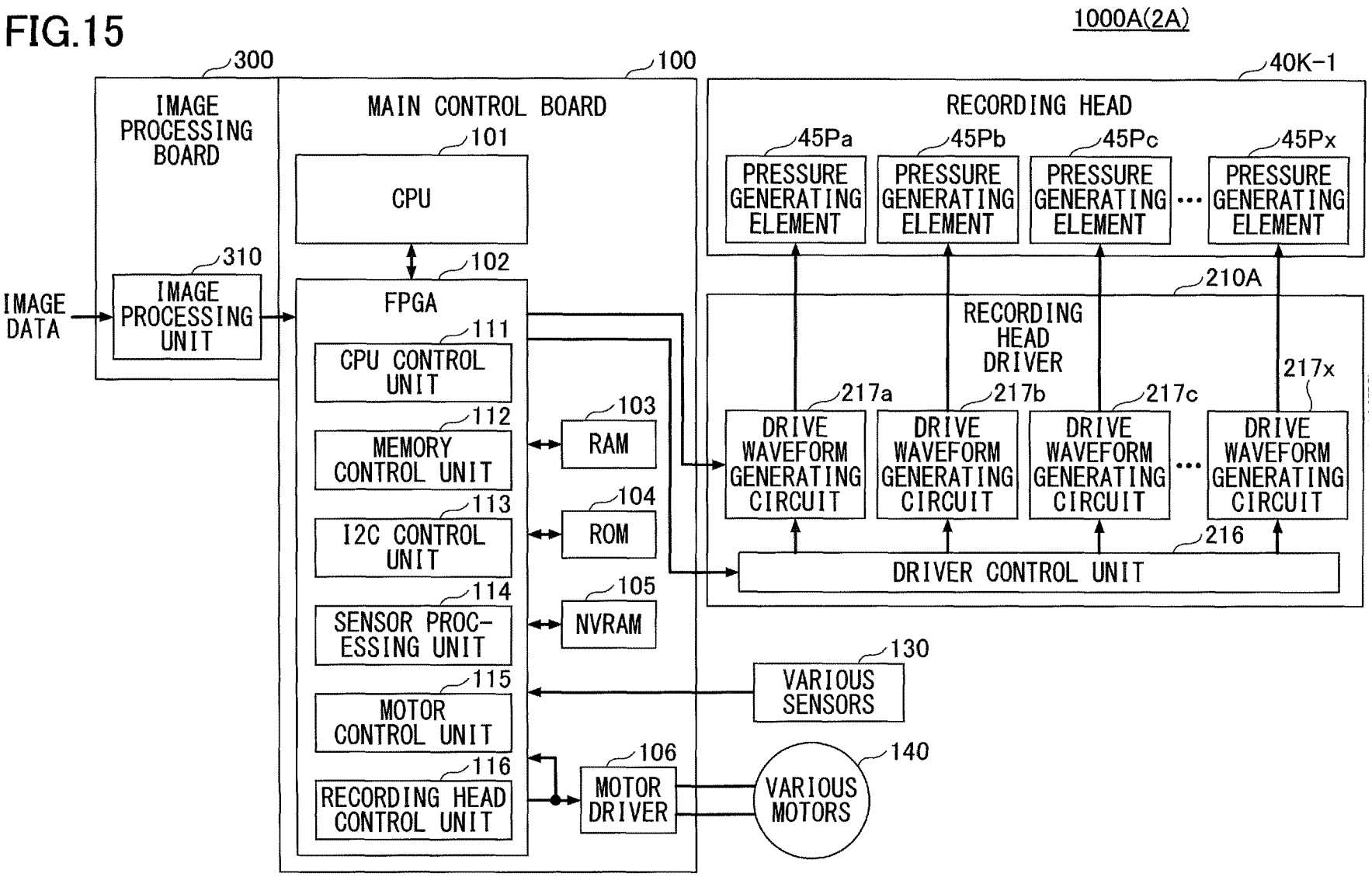
FIG. 15 is a block diagram including an example of a hardware configuration of an image forming apparatus according to another embodiment of the invention.

FIG. 15 is a block diagram illustrating an example of a hardware configuration of an image forming apparatus according to another embodiment of the present invention.

In the configuration illustrated in FIGS. 5 and 6, the driving waveform generating circuit 107 is provided in the main control board 100. However, in this embodiment, the driving waveform generating circuit 217*a* is provided in the interior of the recording head driver 210A with the same number as a plurality of piezoelectric elements 45Pa to 45Px corresponding to a nozzle. The recording head driver 210A is provided with a driver control unit 216 for controlling a plurality of drive waveform generating circuits (a plurality of drive waveform generating means) 217*a* to 217*x*.

In this configuration, because the drive waveform generating circuits 217*a* to 217*x* are provided corresponding to the piezoelectric elements 45Pa to 45Px, the drive waveform generating circuits 217*a* to 217*x* generate the droplet size for applying to the piezoelectric elements 45Pa to Px and the drive waveforms suitable for micro-driving on the basis of the image data SD' including the droplet discharge waveform and the data of the micro-driving pulse, respectively.

Specifically, in this embodiment, the drive waveform generated by the drive waveform generating circuits 217*a* to 217*x* is selected from a plurality of discharge pulses that cause a plurality of droplet sizes of liquid to be discharged or a micro-drive pulse that causes a change in the meniscus so as not to cause the liquid to be discharged from the nozzle.

In the drive waveform generated, the end of the plurality of discharge pulses is equal, or the interval between one pulse end and another pulse end included in the plurality of discharge pulses is an integral multiple of the natural vibration cycle Tc of the liquid chamber.

The drive waveform generating circuits 217*a* to 217*x* generate, for example, the drive waveforms for large droplets, medium droplets, and small droplets including the discharge pulse, or the micro driving pulses for the white ground (for a portion in which liquid is not discharged) for each discharge cycle for each piezoelectric element 45Pa to 45Px.

When the electric potential of the micro-drive pulse and the discharge pulse changes in the same direction, the drive waveform generating circuits 217*a* to 217*x* generate and apply a micro-drive pulse at a timing of an integer multiple of the natural vibration cycle Tc of the liquid chamber with respect to the discharge pulse of the one preceding discharge cycle during continuous driving at the start timing of the white area after discharging the non-discharge immediately preceding droplet which is a continuous discharge drop trailing end or a single drop.

On the other hand, when the electric potential of the micro drive pulse and the discharge pulse is changed in a different direction, the drive waveform generating circuits 217*a* to 217*x* generate and apply the micro drive pulse at a timing of "N×Tc+0.5Tc" when the natural vibration cycle Tc and integer N of the liquid chamber is set to the discharge pulse of one preceding period during continuous driving in a start period of the white land after the discharge of the non-discharge immediately preceding droplet.

Incidentally, although the present configuration example has been described in which the drive waveform of each droplet type is generated for each nozzle, the drive waveform may be generated for each nozzle using a plurality of nozzles as a block.

In this embodiment, a micro-drive pulse for preventing ink drying is used for preventing satellite droplets. Therefore, without performing any special processing for the conversion processing of image data, the image data in which a micro-drive pulse is always arranged in a white area can be utilized to provide a satellite shortening effect only for the non-discharge immediately preceding drops that border the white area.

Although the preferred embodiments have been described in detail above, various modifications and substitutions can be made to the embodiments described above without departing from the scope of the appended claims.

For example, although the above embodiment has been described with reference to an image forming apparatus including a recording head according to the present invention, the liquid discharge head according to the present invention and control thereof can be broadly applied to an apparatus for discharging liquid including an image forming apparatus.

For example, in the present embodiment, the recording heads 40 and 6 included in the head unit for forming an image for discharging ink as the liquid discharging head have been described as examples. However, in the discharge head of the preprocessing means or the post-processing means, for example, micro-drive control of the liquid discharging head according to the present invention may be performed.

In the present application, an "apparatus for discharging liquid" includes a liquid discharging head or a liquid discharging unit to drive a liquid discharging head to discharge liquid. An apparatus for discharging liquid includes an apparatus that is capable of discharging liquids into an air or liquid, as well as an apparatus that is capable of discharging liquids into an air or liquid.

The "apparatus for discharging liquid" may include a means for feeding, conveying, and discharging a liquid that can be adhered to the apparatus, as well as other apparatus for pretreatment and aftertreatment.

For example, "apparatus of discharging liquid" includes an image forming apparatus that discharges ink to form an image on a paper, and a stereo forming apparatus (three-dimensional molding apparatus) that discharges shaped liquid into a powder layer in which powder is layered in order to shape a three-dimensional object (three-dimensional molding apparatus).

Further, the "apparatus of discharging liquid" is not limited to those in which a significant image, such as a character or a graphic, is visualized by the discharged liquid. These examples include those that form patterns that have no meaning in themselves, and those that shape a three-dimensional image.

The term "a liquid that can be attached" as used above means a liquid that can be attached to it at least temporarily, adhered to it, adhered to it and infiltrated, etc. These examples include media to be recorded, such as paper, recording paper, recording paper, film, cloth, etc., electronic components, such as electronic boards, piezoelectric elements, powder layers, organ models, test cells, etc., and, unless otherwise specified, include all media to which liquid adheres.

The "liquid adhesive material" may be a liquid such as paper, yarn, fiber, fabric, leather, metal, plastic, glass, wood, ceramic, or the like temporarily.

Moreover, the "liquid discharge head" is not limited to the pressure generating element to be used. For example, a piezoelectric actuator (a laminated piezoelectric element may be used), a thermal actuator using an electrothermal conversion element such as an exothermic resistor, an electrostatic actuator consisting of a vibration plate and a counter-electrode, or the like may be used.

In addition, the terms of the present application, such as image formation, recording, printing, printing, printing, and molding, are all synonymous.

According to one aspect, in a liquid discharge apparatus, a satellite shortening effect at the trailing end of the discharge droplet can be enhanced without any special processing for the conversion of image data.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although a liquid discharge apparatus has been described in detail, it should be understood that various changes, substitutions, and alterations could be made thereto without departing from the spirit and scope of the invention.

According to one aspect, in a liquid discharge apparatus, a satellite shortening effect at the trailing end of the discharge droplet can be enhanced without any special processing for the conversion of image data.

EXPLANATION OF SYMBOLS

1: Paper (recording medium);
2: Image forming apparatus (line-type image forming apparatus, liquid discharge apparatus);
6K, 6C, 6M, 6Y: Recording head (liquid discharge head);
40K-1,40K-2,40K-3,40K-4: Recording head (liquid discharge head);
40F: Liquid chamber (pressure chamber);
40N: Print nozzle;
45P (45Pa-45Px): Piezoelectric element (pressure generating element, pressure generating means);
107: Drive waveform generating circuit (drive waveform generating means);
116: Recording head control unit;
210: Recording head driver (waveform selection unit);
210A: Recording head driver;
217: Drive waveform generating circuit (a plurality of drive waveform generating means);
1000: Image forming apparatus (serial-type image forming apparatus and liquid discharge apparatus);
T1, T2, T3, T4: Intervals between application;
T5: Interval between the pulse terminations of a plurality of discharge pulses;
Tc: Natural oscillation period; and
Vcom: Drive waveform.

What is claimed is:

1. A liquid discharge apparatus comprising
a liquid discharge head including
a nozzle discharging liquid onto a recording medium, a liquid chamber communicating with the nozzle, and a pressure generating unit generating pressure by a change in a drive waveform of the liquid in the liquid chamber;
a drive waveform generating unit generating the drive waveform applied to the pressure generating unit; and
a waveform selection unit selectively masking a part of the drive waveform applied to the pressure generating unit and selecting a pulse of the drive waveform applied to the pressure generating unit,
wherein the drive waveform includes at least one discharge pulse for discharging the liquid and a micro-drive pulse for causing a change in meniscus so that the liquid is not discharged from the nozzle at a point where the liquid is not discharged on the recording medium,
wherein the micro-drive pulse is disposed at a head of a discharge cycle of the drive waveform, and
wherein, when electric potential of the micro-drive pulse and electric potential of the discharge pulse change in different directions, the micro-drive pulse is disposed at a position satisfying "N×Tc+0.5Tc" relative to the discharge pulse of an immediately previous discharge cycle during continuous driving where Tc is a natural vibration cycle of the liquid chamber and N is an integer.

2. A liquid discharge apparatus according to claim 1,
wherein the micro-drive pulse has a waveform having a rise element having a predetermined gradient, a potential hold element, and a fall element having a predetermined gradient in time series,
wherein the discharge pulse has a waveform having a fall element having a predetermined gradient, the potential hold element, and a rise element having a predetermined gradient in a time series, and
wherein the micro-drive pulse is arranged so that a time from a start of the rise element of the discharge pulse of the one discharge cycle ahead to a start of the fall element of the micro-drive pulse is "N×Tc+0.5Tc" where Tc is a natural vibration cycle of the liquid chamber and N is an integer.

3. The liquid discharge apparatus according to claim 1,
wherein when the drive waveform is a common drive waveform including a plurality of discharge pulses that cause a plurality of drop-sized liquids to be discharged within the discharge cycle,
wherein an end of the discharge pulses is equal, or an interval between one pulse end and another pulse end included in the plurality of discharge pulses is an integral multiple of the natural vibration cycle Tc of the liquid chamber, and
wherein, in the common drive waveform, the micro-drive pulse is arranged with the length adjusted for a final discharge pulse of any one discharge drop with one discharge cycle preceding.

4. The liquid discharge apparatus according to claim 1,
wherein, in the drive waveform, the micro-drive pulse is arranged with an error within ±(¼)Tc of a target position with respect to the natural vibration cycle Tc of the liquid chamber.

5. The liquid discharge apparatus according to claim 1,
wherein the micro-drive pulse is selectively used for as position on the recording medium where the liquid is not discharged.

6. The liquid discharge apparatus according to claim 1,
wherein, at an end of the discharge cycle after the discharge pulse, a damping pulse having a potential change in a direction different from the discharge pulse is included.

7. A method for controlling a liquid discharge including
a nozzle discharging liquid onto a recording medium,
a liquid chamber communicating with the nozzle, and
a pressure generating unit generating pressure by a change in a drive waveform of the liquid in the liquid chamber, the method comprises:
a drive waveform generating step of generating the drive waveform applied to the pressure generating unit; and
a waveform selection step of selectively masking a portion of the drive waveform and selecting a pulse of the drive waveform applied to the pressure generating unit,
wherein the drive waveform includes at least one discharge pulse for discharging liquid and a micro-drive pulse for causing a change in meniscus so that liquid is not discharged from a nozzle at a point on the recording medium,
wherein the micro-drive pulse is disposed at a head of a discharge cycle of the drive waveform, and
wherein, when electric potential of the micro-drive pulse and electric potential of the discharge pulse change in different directions, the micro-drive pulse is disposed at a position satisfying "N×Tc+0.5Tc" relative to the discharge pulse of an immediately previous discharge cycle during continuous driving where Tc is a natural vibration cycle of the liquid chamber and N is an integer.

* * * * *